US005425424A

United States Patent [19]

Reinhardt et al.

[11] Patent Number: 5,425,424

[45] Date of Patent: Jun. 20, 1995

[54] CASING VALVE

[75] Inventors: Paul A. Reinhardt, Houston; Douglas J. Murray, Humble, both of Tex.

[73] Assignee: Baker Hughes Incorporated, Houston, Tex.

[21] Appl. No.: 204,466

[22] Filed: Feb. 28, 1994

[51] Int. Cl.[6] ..... E21B 33/13

[52] U.S. Cl. ..... 166/291; 166/55.8; 251/344

[58] Field of Search ..... 166/55.1, 55.2, 55.8, 166/100, 269–271, 275, 291, 297; 251/344

[56] References Cited

U.S. PATENT DOCUMENTS

| | | | |
|---|---|---|---|
| 2,707,997 | 5/1955 | Zandmer et al. | 166/100 X |
| 2,708,000 | 5/1955 | Zandmer | 166/100 |
| 2,775,304 | 12/1956 | Zandmer | 166/100 |
| 2,855,049 | 10/1958 | Zandmer | 166/100 |
| 3,057,405 | 10/1962 | Mallinger | 166/100 X |
| 3,120,268 | 2/1964 | Caldwell | 166/100 |
| 3,245,472 | 4/1966 | Zandmer | 166/100 |
| 3,326,291 | 6/1967 | Zandmer | 166/100 |
| 3,347,317 | 10/1967 | Zandmer | 166/100 |
| 3,382,926 | 5/1968 | Zandmer | 166/100 |
| 3,390,724 | 7/1968 | Caldwell | 166/100 |
| 3,395,758 | 8/1968 | Kelly et al. | 166/100 |
| 3,434,537 | 3/1969 | Zandmer | 166/100 |
| 3,924,677 | 12/1975 | Prenner et al. | 166/100 |
| 4,285,398 | 8/1981 | Zandmer | 166/100 |
| 4,880,059 | 11/1989 | Brandell et al. | 166/332 |
| 4,991,654 | 2/1991 | Brandell et al. | 166/332 |

OTHER PUBLICATIONS

A. Damgaard, D. S. Bangert, D. J. Murray, R. P. Rubbo, G. W. Stout; *A Unique Method for Perforating, Fracturing and Completing Horizontal Wells;* Society of Petroleum Engineers, Paper No. SPE–19282, Presented Offshore Europe 1989 Conference, Aderdeen, Sep. 1989).

*Primary Examiner*—Roger J. Schoeppel
*Attorney, Agent, or Firm*—Rosenblatt & Associates

[57] ABSTRACT

An apparatus and method for producing through a casing without perforation are disclosed. The casing can be rotated while it is cemented and includes a multiplicity of sliding sleeve valves. Each of the valves selectively covers a plurality of pistons, each of which preferably has a rupture disc mounted therein. A pressure-regulating device is provided in association with each rupture disc to ensure retention of sufficient internal pressure in the tubing such that all discs eventually burst without any short circuiting through the discs which ruptured earlier. The outward movement of the pistons acts to assist in fracturing the formation. Thereafter, the pressure used to rupture the discs aids in further channeling the fluid energy of the fluid rupturing the discs, as well as putting additional pressure on the movable pistons to further stress fracture the formation.

As the piston is pumped outward, the grease that is held captive within the piston assembly is forced outward through a bladder. As the grease is pumped out, it displaces the cement slurry and flushes the face of the formation directly in front of the piston. Serrations on the end of the piston assembly concentrate the stresses, causing the piston assembly to bite into the formation. As the piston continues to penetrate the formation, the grease is ejected through the serrations, which helps to further flush the face of the formation. The ejected grease also tends to act as an inhibitor which prevents the cement from setting up in the area around the piston. The interior of the piston assembly will still contain grease which helps prevent the temporary restriction from dissolving.

42 Claims, 23 Drawing Sheets

CASING VALVE

FIELD OF THE INVENTION

The field of the invention relates to downhole completions, particularly completions allowing, in one pass, access to multiple producing zones without perforation.

BACKGROUND OF THE INVENTION

In the past, a casing string would be cemented, followed by a perforation procedure initiated after a specific zone is isolated from the wellbore through the use of packers. Thereafter, when production is required from other zones in the well, the procedure is repeated and the new zone for production is isolated with packers and perforated with a gun. Thereafter, the customary steps of stimulation, reversing, and setting a completion packer are accomplished and the work string is removed. Thereafter, production can begin. A 1989 paper by Damgaard given to the Society of Petroleum Engineers, Paper No. SPE-19282, describes a system wherein multiple zones are perforated and isolated individually with packers and sleeves. The production can be from one zone or multiple zones. Subsequently or at about the same time, the use of casing sleeve valves evolved such that access to the formation could be obtained through dissolvable plugs located behind sliding sleeve valves in the casing. Typical of such applications are U.S. Pat. Nos. 4,880,059 and 4,991,654, Such designs had several shortcomings as far as being able to orient sufficient fracture pressure into the formation. The internal pressure built up in the casing to begin the dissolving process of the plugs illustrated in U.S. Pat. No. 4,880,059 could tend to unevenly erode the plugs, creating flow short circuits. This would reduce the differential pressure on undissolved plugs and would tend to impede their rate of dissolution. The additional resistance offered by the plugs which slowly dissolve would decrease the available pressure into the formation by the fluid in the casing. This was because any pressure drop taken across the plugs which have yet to fully dissolve would decrease the available pressure drop into the formation from the fluid in the casing. The lack of a conduit for communication for the flow that ultimately penetrates the dissolving plugs also tended to reduce the concentration of force applied to the formation through the opening in which the dissolving plug was mounted and thereby reduce the overall stresses applied to the formation in an attempt to fracture the formation. Much earlier, telescoping access ports were disclosed in U.S. Pat. No. 3,359,758. In that patent, multiple tubing strings were run, each of which had a telescoping outlet at a different depth. The wellbore was then filled with cement, with each tubing string swabbed to induce any obstructing cement over the telescoping openings back into the wellbore so that it can be removed to the surface. Thus, the telescoping openings were used more for positioning of the tubing rather than as a mechanism for inducing formation stress. These telescoping outlet assemblies did not contain a prepackaged fluid which could move out with the telescoping conduit to keep it free of cement or wellbore fluids.

The apparatus and method of the present invention allow access at multiple levels without perforation. The movable pistons extend outwardly to create fracture stresses in the formation. Through pressure in the tubing, in combination with the disclosed rupture disc assemblies, additional stress is put on the formation from fluid force coming behind the bursting of the discs. Further, the pressure acts to drive the movable pistons further into the formation to the extent they have not achieved their full outward movement by the time they are displaced toward the formation prior to breakage of the rupture discs. The fluid energy is transmitted directly to the formation through the flowpath created by the pistons to further aid in fracturing the formation for subsequent production from the well.

When a specific zone is played out, a valve adjacent that zone may be closed and a separate valve opened with a shifting tool to allow access for production from a different zone or from a different location of the same zone. The single packer above the highest completion is used, regardless of which zone is aligned for flow into the casing.

The method of the present invention also facilitates rotation of the casing during the cementing procedure.

SUMMARY OF THE INVENTION

An apparatus and method for producing through a casing without perforation are disclosed. The casing can be rotated while it is cemented and comprises of a multiplicity of sliding sleeve valves. Each of the valves selectively covers a plurality of pistons, each of which preferably has a rupture disc mounted therein. A pressure-regulating device is provided in association with each rupture disc to ensure retention of sufficient internal pressure in the tubing such that all discs eventually burst without any short circuiting through the discs which ruptured earlier. The pressure-regulating device has a unique hole pattern providing a greater degree of disintegration control as flowing fluid initiates dissolution of the regulating device to promote full flow capability to the formation for fracturing or other procedures. The outward movement of the pistons acts to assist in fracturing the formation. Thereafter, the pressure used to rupture the discs aids in further channeling the fluid energy of the fluid rupturing the discs, as well as putting additional pressure on the movable pistons to further stress fracture the formation. These pistons can be arrayed in a spiral form or in other radial patterns around the casing so that pistons are disposed around the complete periphery.

As the piston is pumped outward, the grease that is held captive within the piston assembly is forced outward through a bladder. As the grease is pumped out, it displaces the cement slurry and flushes the face of the formation directly in front of the piston. Serrations on the end of the piston assembly concentrate the stresses, causing the piston assembly to bite into the formation. As the piston continues to penetrate the formation, the grease is ejected through the serrations, which helps to further flush the face of the formation. The ejected grease also tends to act as an inhibitor which prevents the cement from setting up in the area around the piston. The interior of the piston assembly will still contain grease which helps prevent the temporary restriction from dissolving.

DETAILED DESCRIPTION OF THE PREFERRED EMBODIMENT

Figure 1:
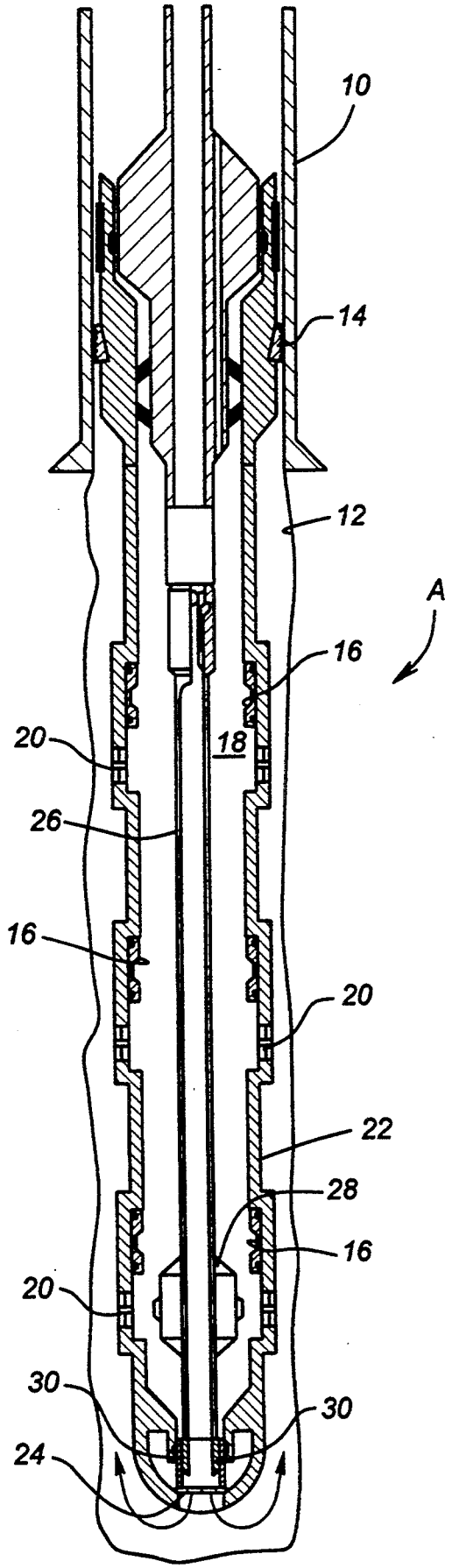
FIG. 1 schematically illustrates the method of the present invention prior to pumping the cement to set the casing.

The method of the present invention is illustrated schematically in FIGS. 1–7. In FIG. 1, casing 10 is run into wellbore 12. The apparatus A of the present invention is lowered through casing 10 and suspended therefrom through slips 14. The apparatus A contains a plurality of sliding sleeve members 16, all illustrated in FIG. 1 in the open position. While in the open position, the members 16 leave exposed to the interior 18 of the apparatus A a plurality of plug assemblies 20. The plug assemblies 20 are distributed in an array around wall 22 so that they are all exposed when the sliding sleeve member 16 is in the position illustrated in FIG. 1. The plug assemblies 20 are also disposed in four staggered spirals beginning at 90° intervals so that plug assemblies 20 are disposed completely around the apparatus A. At the lower end of the apparatus A is a standard float shoe 24 frequently used in cementing operations. A work string 26, which can also hold the shifting tool 28, is stabbed into float shoe 24 to push flapper valves 30 into the open position.

Figure 2:
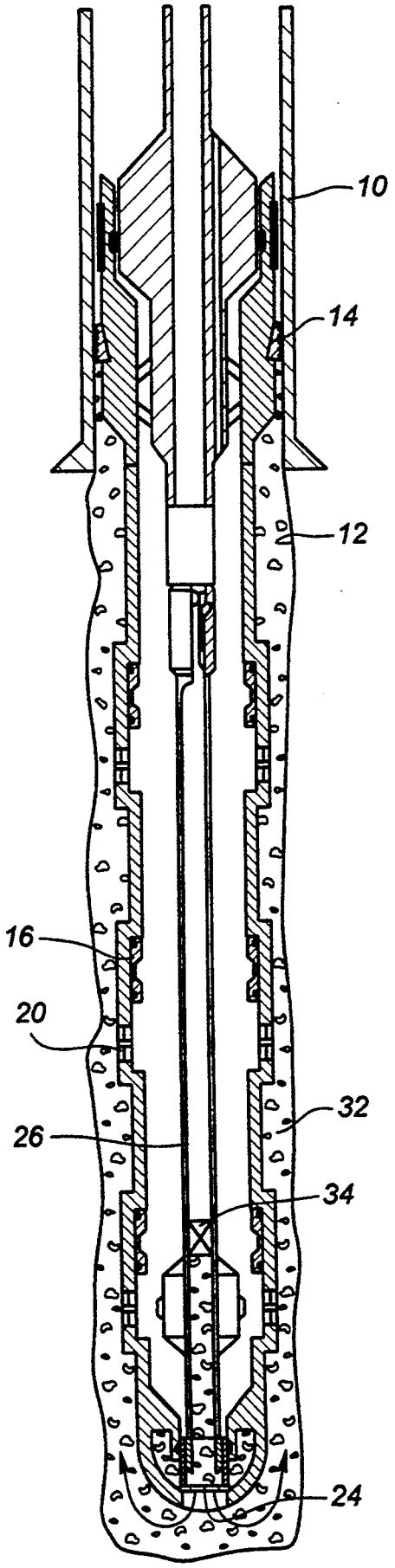
FIG. 2 schematically illustrates the method of the present invention during the cementing step.

The next step is illustrated in FIG. 2 where the cement is pumped down work string 26 through float shoe 24 and into the annular space 32 between the wellbore 12 and the apparatus A. A plug 34 is dropped after the cement to wipe the cement from the work string 26 and push it through float shoe 24 and into annulus 32.

Figure 3:
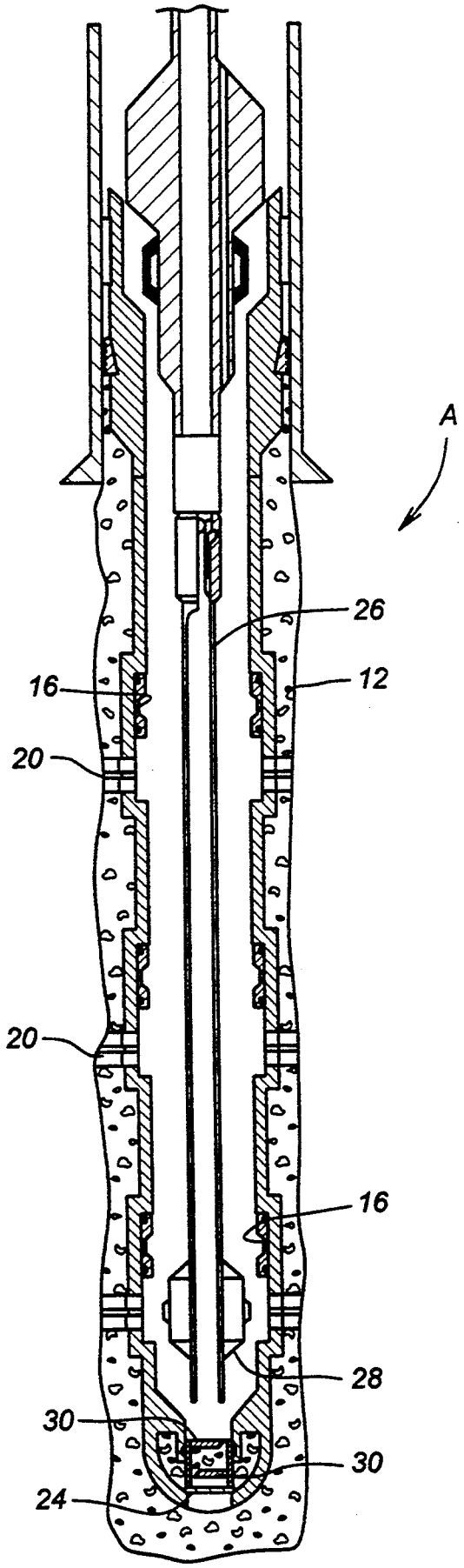
FIG. 3 illustrates the method of the present invention, showing the cleanup step subsequent to cementing, as well as the extension of the movable pistons.
Figure 4:
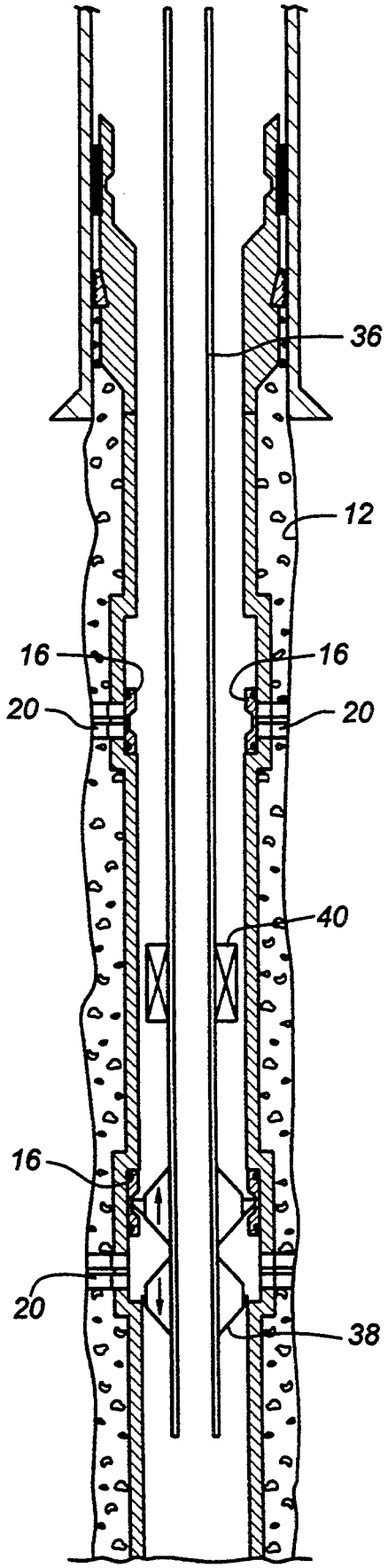
FIG. 4 schematically illustrates the method of the present invention, illustrating the opening of one of the sliding sleeve valves, with the others being closed.

The work string 26 is shown in a retracted position in FIG. 3, allowing flapper valves 30 to be biased into the closed position. The shifting tool 28 remains adjacent the lower end of the work string 26. With all the sliding sleeve members or valves 16 in the open position, pressure is initiated through the work string 26 to bias the plug assembly 20 outwardly into contact with the wellbore 12. The mechanical details of the plug assembly 20 will be subsequently described. It suffices at this point to say that the outward movement of the plug assembly 20 into the wellbore 12 creates a fracture force on the wellbore 12 which assists in ultimate fluid penetration of the formation through the plug assembly 20. The casing or apparatus A can be rotated during cementing. Once the plug assemblies 20 are extended, rotation is no longer possible or desired.

As shown in FIG. 3, the shifting tool 28 is used to close all of the sliding sleeve valves 16. In the preferred embodiment, the shifting tool 28 is used to close all the sleeves 16 on the way out of the hole. Thereafter, a fracturing string 36 is run in the hole with a shifting tool 38. Shifting tool 38 has the capability of moving valve members 16 as required. Fracturing string 36 is run in with a service packer 40. The shifting tool 38 is used to open one of the sliding sleeve members 16 and preferably the lowermost member.

Figure 5:
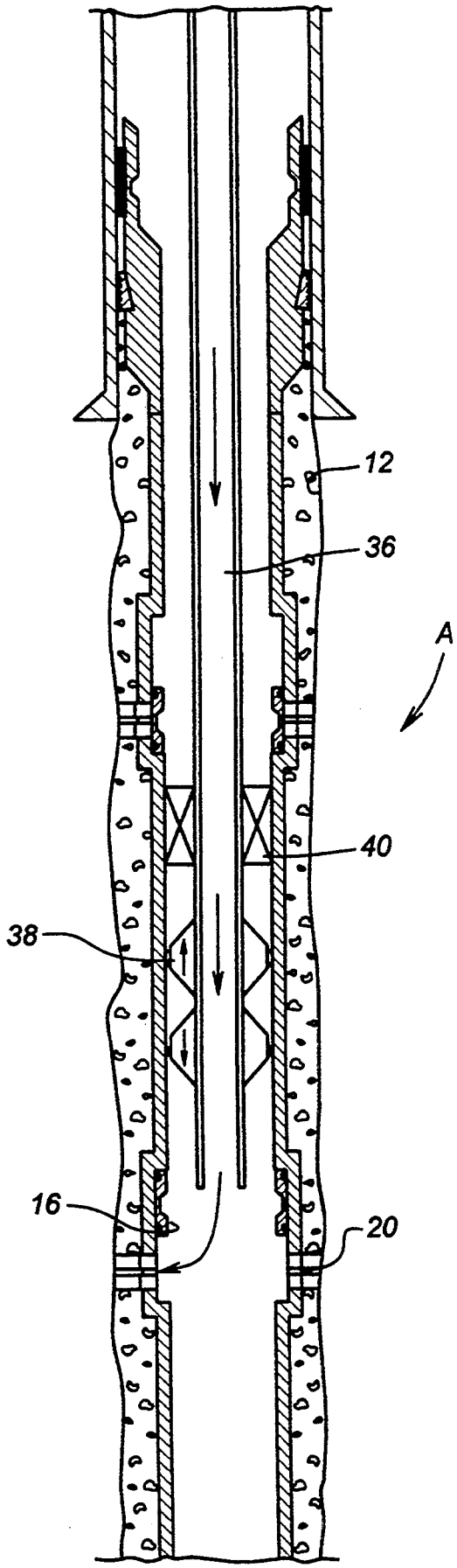
FIG. 5 illustrates the method of the present invention, showing the discs being ruptured and the formation being fractured.
Figure 6:
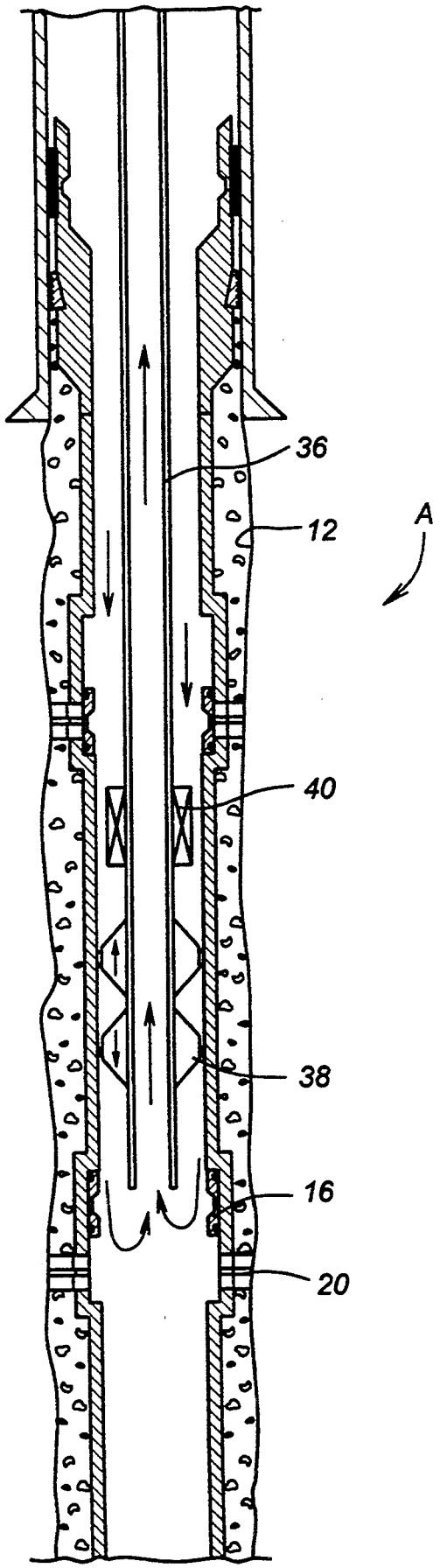
FIG. 6 is a schematic illustration of the method of the present invention, showing the clean-up procedures at the conclusion of the fracturing through one of the open sliding sleeve valves.
Figure 7:
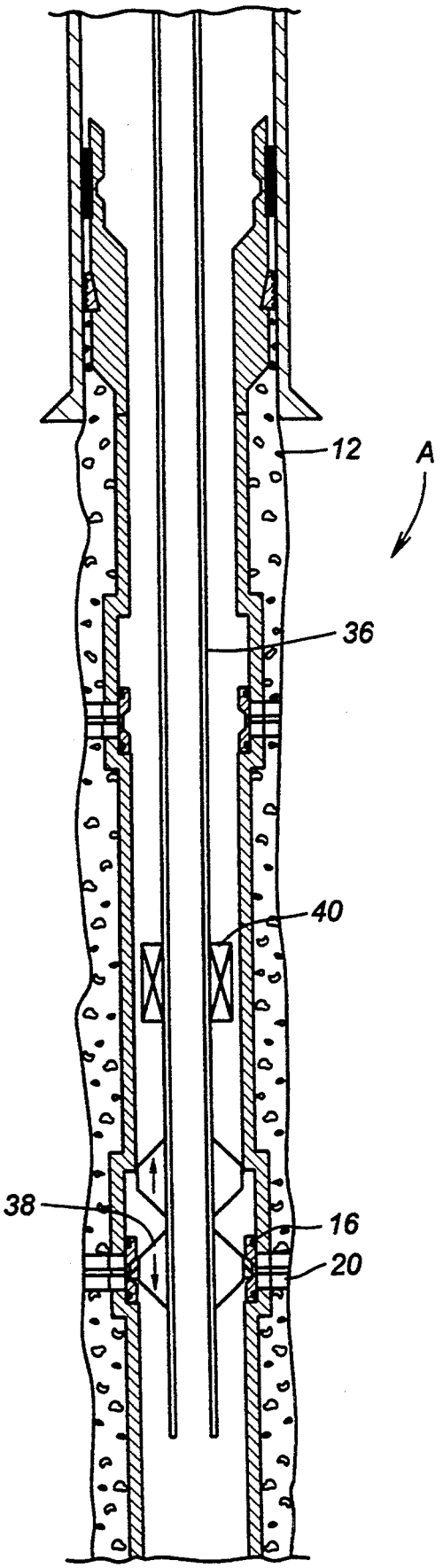
FIG. 7 is a schematic illustration of a repetition of steps previously described, however at a different location in the wellbore.

Thereafter, as shown in FIG. 5, the service packer 40 is set against the apparatus A and pressure is developed through the fracturing string 36. The pressure ultimately breaks through plug assembly 20, as will be described below, and creates a fracturing force on the formation of the wellbore 12. At the completion of the fracturing procedure shown in FIG. 5, the service packer 40 is unset, as shown in FIG. 6, and reverse circulation is initiated to clean up the apparatus A. FIG. 7 illustrates the use of shifting tool 38 to close the lowermost sliding valve 16, thus allowing the fracturing string 36 to be pulled uphole for actuation of another sliding sleeve valve 16, with the previous steps being repeated.

Figure 14:
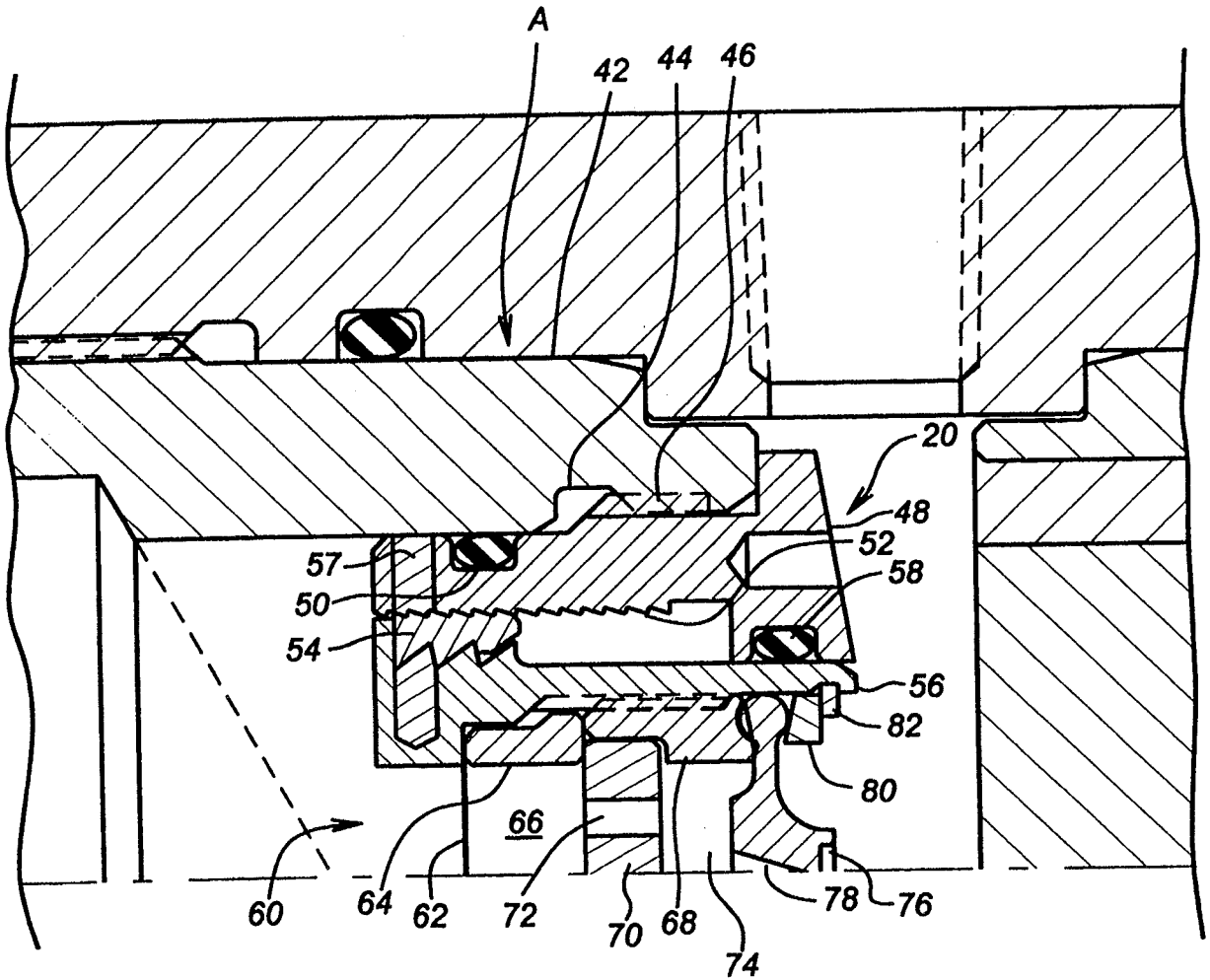
FIG. 14 illustrates the mechanical construction of the sliding sleeve-rupture disc assembly.

The method and apparatus A of the present invention are further illustrated in FIGS. 8–13. These views are in sections through the apparatus A, illustrating in detail an embodiment of plug assembly 20. The specific structure of the plug assembly 20 is shown in greater detail in FIG. 14. There, the apparatus A is shown to be a liner 42, having a plurality of openings 44 into which a plug assembly 20 is inserted. Each opening 44 can have a thread 46 to secure an insert 48. Insert 48 is in sealable contact with opening 44 by virtue of seal 50. Insert 48 has a plurality of ratchet teeth 52. A body lock ring 54 moves in tandem with piston 56 such that outward movement of piston 56, after shearing pin or pins 57, ratchets body lock ring 54 along ratchet ring 52 to prevent retraction of pistons 56 once they are outwardly driven. Each piston 56 is sealably connected with respect to insert 48 by virtue of seal 58. Piston 56 has a central bore 60 which is obstructed by a rupture disc 62. Ring 64 retains disc 62 against piston 56. Ring 64 has a bore 66 therethrough which is substantially in alignment with bore 60 such that upon rupture of disc 62, bore 60 is continued through bore 66. Restrictor ring 68 retains ring 64 against piston 56. Restrictor ring 68 also retains dissolving restricting plate 70 in the position shown in FIG. 14 adjacent bore 66. Dissolving restricting plate 70 has at least one opening 72 therethrough, and has an opening pattern illustrated in view A1 in FIG. 15. Restricting dng 68 has a bore 74 which is closed off by flexible bladder 76. Bladder 76 is flush or recess-mounted so that it does not impede or get damaged by insertion of liner 42. The space occupied by bore 66, opening 72, and bore 74 is initially filled with preferably grease to protect the dissolving restriction plate 70 from premature fluid contact. Flexible bladder 76 has a check valve 78 which allows flow out of bore 74 in the event that unbalanced forces on bladder 76 cause it to flex inwardly. These forces arise from thermal effects from wellbore fluids, causing an expansion force on the grease packed into bores 66, 74, and openings 72 such that the essentially incompressible grease will need to be displaced into the wellbore through check valve 78. However, check valve 78 prevents wellbore fluids from entering bore 74. A holddown ring 80 helps retain bladder 76 to restrictor ring 68. A snap ring 82 secures ring 80 against bladder 76.

As previously stated, underneath each sliding sleeve member 16 is an array of plug assemblies 20. As shown in FIG. 3, with all the sliding sleeve members 16 open, pressure is introduced into the apparatus A generally between 750–1250 psi to initiate outward movement of all the pistons 56 against the formation 12 by shearing pins 57. Thereafter, as shown in FIG. 5, the pressure is further increased to generally in the range of about 3000 psi. While significantly different, actuation pressures for said pistons and said rupture discs are disclosed, other set points can be used, even identical set points can be used, without departing from the spirit of the invention. While all the rupture discs 62 are set to fail by this pressure, manufacturing tolerances allow for some variability in the burst pressure of rupture discs 62. Further, among all the rupture discs exposed to the pressure illustrated in the view of FIG. 5, the early or premature failure of some of the rupture discs 62 ahead of the others can create a flowpath of least resistance into the formation that tends to decrease the internal pressure in the liner 42. Thus, potentially, the differential pressure against the unruptured discs is reduced. The effects of such short circuiting due to early breakage of some of the rupture discs could possibly create a situation where some of the rupture discs 62 just do not break. It is desirable that all discs 62 break all around liner 42 to impart significant hoop stress to the formation to assist in its fracture and penetration of liquids into the formation through the broken discs 62.

Figure 15:
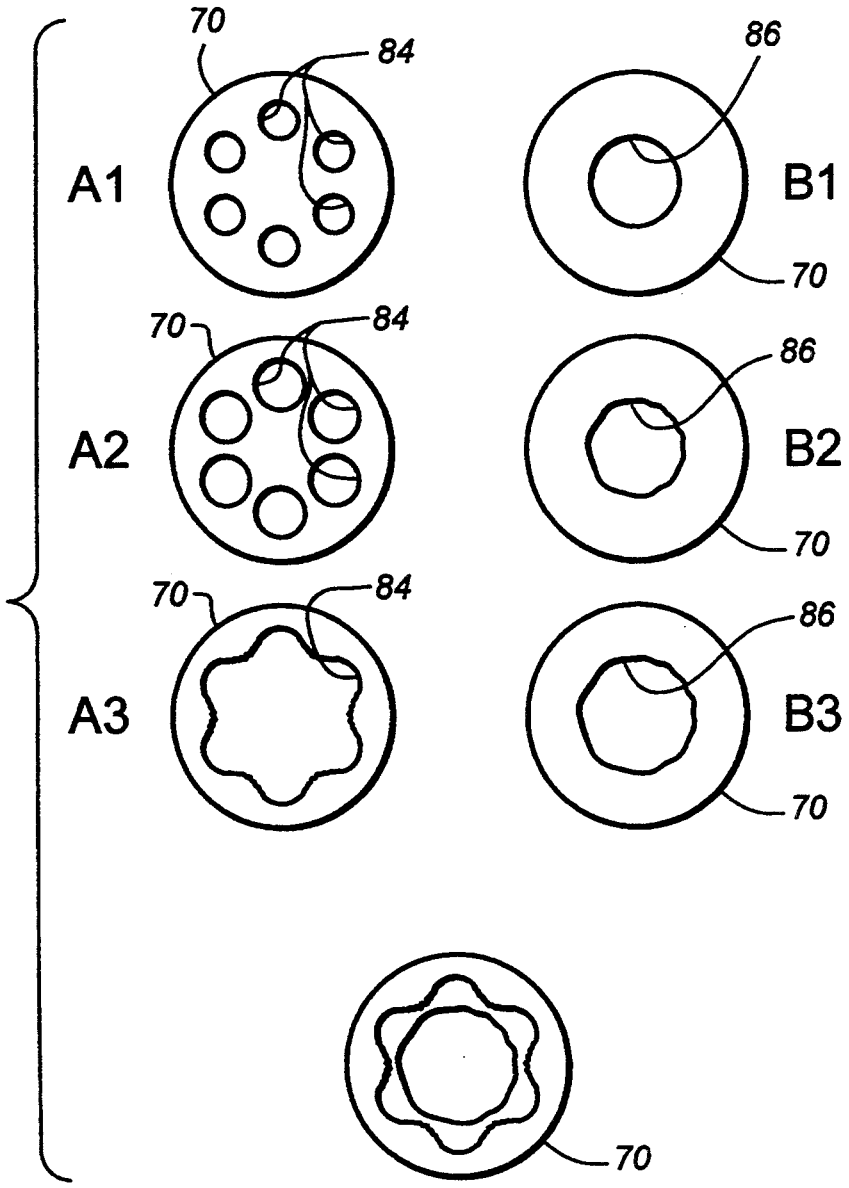
FIG. 15 illustrates a comparison in the temporary flow restrictors, showing the differences in a single central flow restriction as compared to a plurality of peripheral restrictions.

In order to avoid this situation, dissolving restriction plate 70 is placed behind rupture disc 62 encased in the grease found in bores 66, 74, and openings 72. FIG. 15 illustrates two potential designs for dissolving restriction plate 70. The plate can be made from any readily dissolvable materials such as aluminum. In FIG. 15, A1 indicates a plurality of openings 84 disposed about the periphery of the plate 70 prior to breakage of rupture disc 62. On the other hand, the view labeled B1 in FIG. 15 is another embodiment of a plate 70 having one central orifice 86. As the rupture disc 62 breaks and flow is initiated through bore 66 into openings 84 or 86, the openings begin to grow. View A3 of FIG. 15 shows sufficient growth in the openings 84 so that the central mass between them becomes unsupported and is blown through by the fluid pressure from the surface. In contrast, the opening in plate 72, illustrated in view B3 of FIG. 15, shows continuing erosion of a central orifice 86. The final view in FIG. 15 illustrates a super imposition of the view in A3 over the view in B3, showing that a substantially larger opening has developed in plate 70 more quickly in the embodiment having a plurality of openings 84 than in the embodiment having a single orifice opening 86. This can be significant because failure of plate 70 to disintegrate sufficiently quickly can create an artificial support for rupture disc 62, preventing it from getting fully blown through bore 74. By using a plurality of openings displaced about the periphery, the potential material selected for the plate 70 has greater versatility for a variety of applications. There are two conflicting criteria for the plate 70. On one hand, the plate must retain its integrity as an orifice plate for a small period of time to allow the remaining unbroken discs 62 time to fail due to pressure differential. At the same time, plate 70 must quickly erode so that a clear path for fluid flow through the piston 56 and into the formation can take place. Accordingly, the preferred perforating layout shown in view A1 of FIG. 15 lends more versatility to the material selected to be plate 70. The size and spacing of the openings 84 can be selected so as to regulate the time it takes for the plate 70 to go from the condition shown in view A1 to the condition shown in view A3. It should be noted that very quickly after the failure of a rupture disc 62, bladder 76 is blown through piston 56. Any remaining cement lodged between bladder 76 and the formation 12 is also displaced by the fluid pressure introduced through the fracturing string 36.

Figure 8:
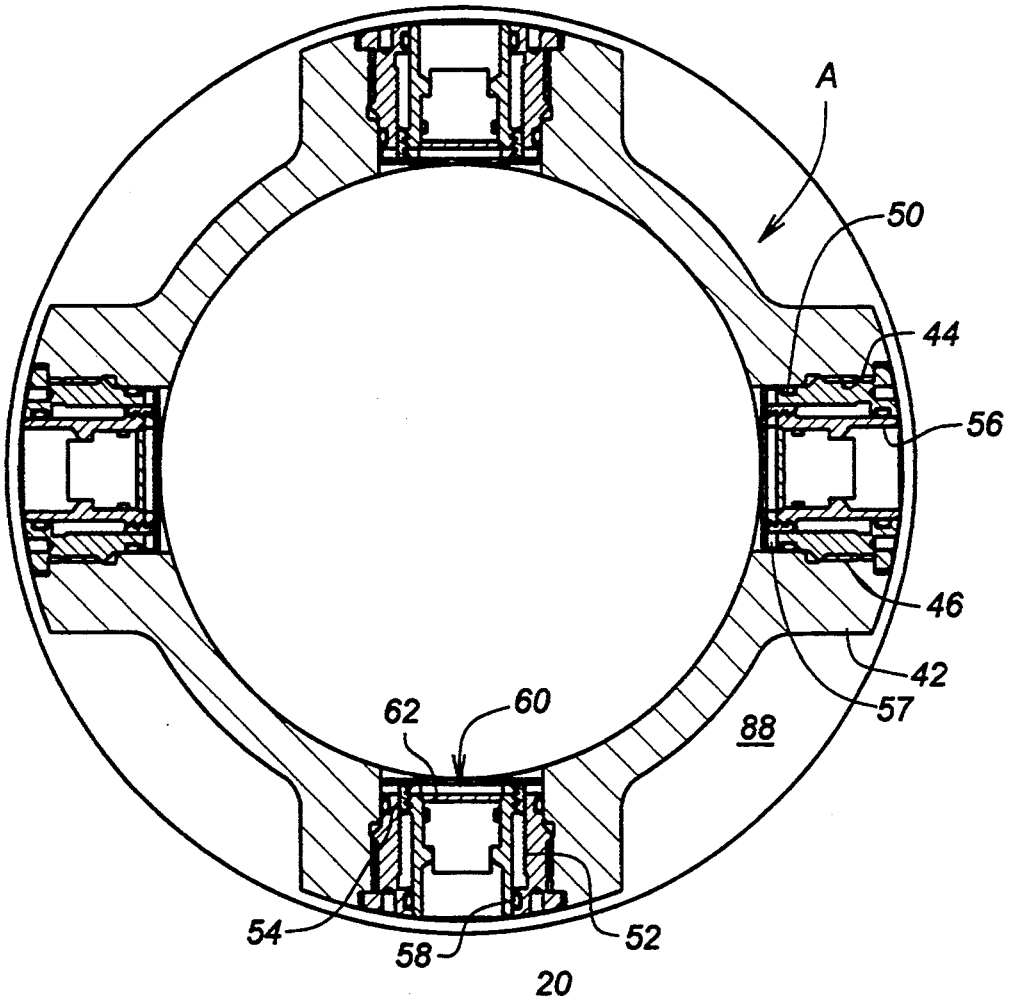
FIG. 8 is a sectional view through the valve housing, illustrating the layout of the rupture disc openings in the run-in position.
Figure 9:
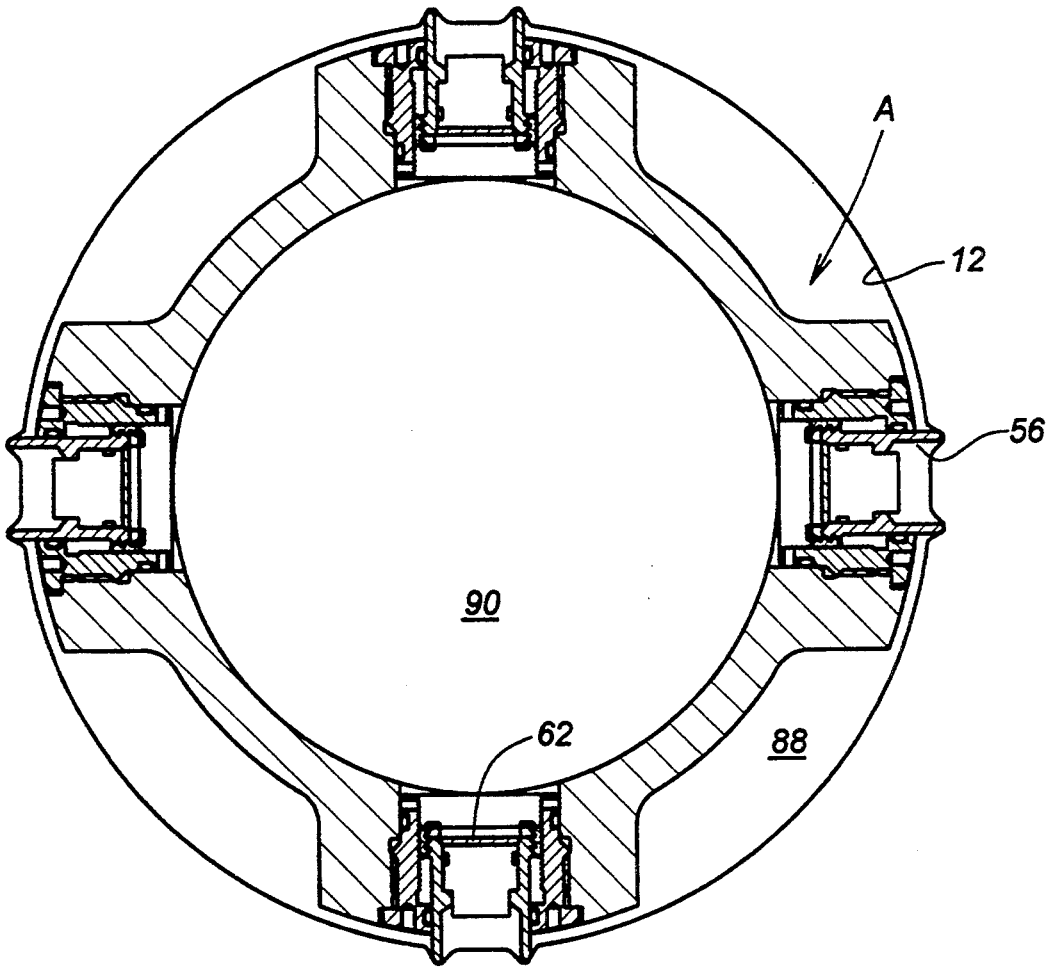
FIG. 9 illustrates the step of moving the pistons outwardly into the formation.
Figure 10:
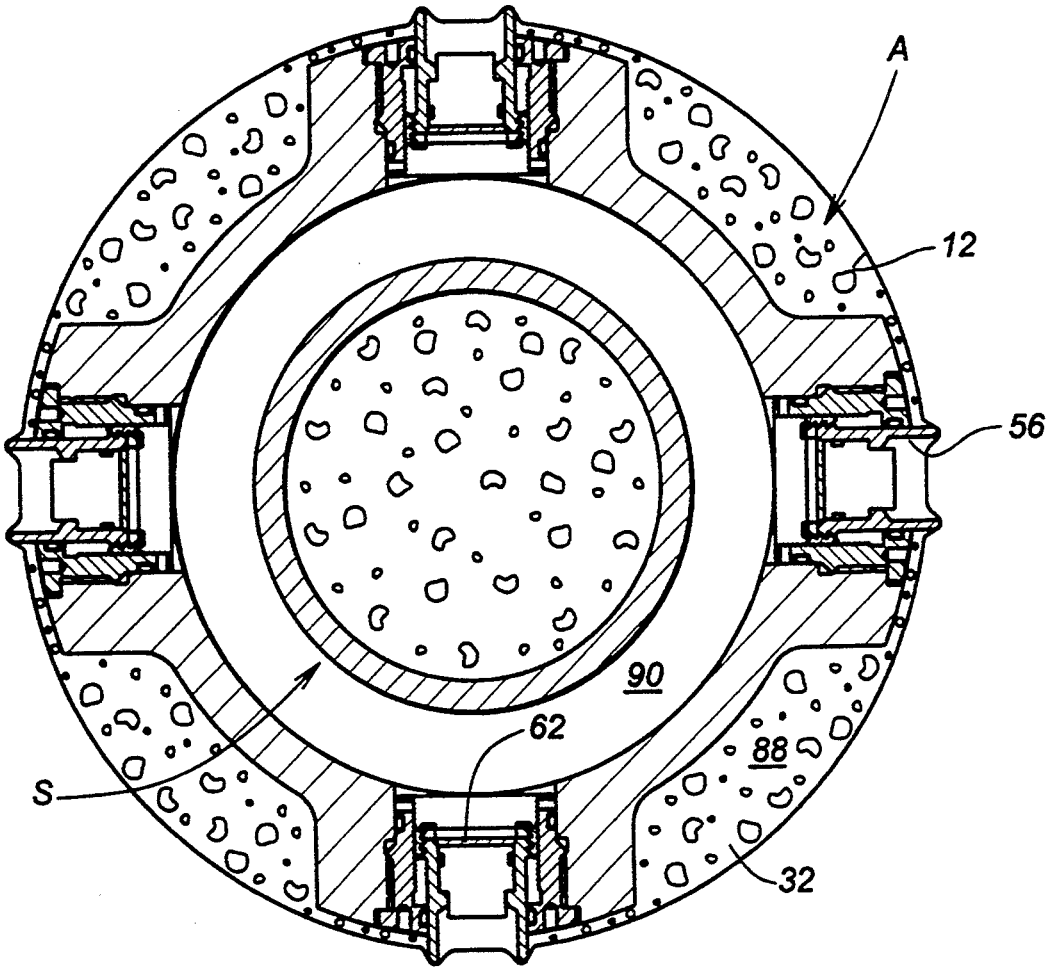
FIG. 10 illustrates the cementing step with the pistons moved out.
Figure 11:
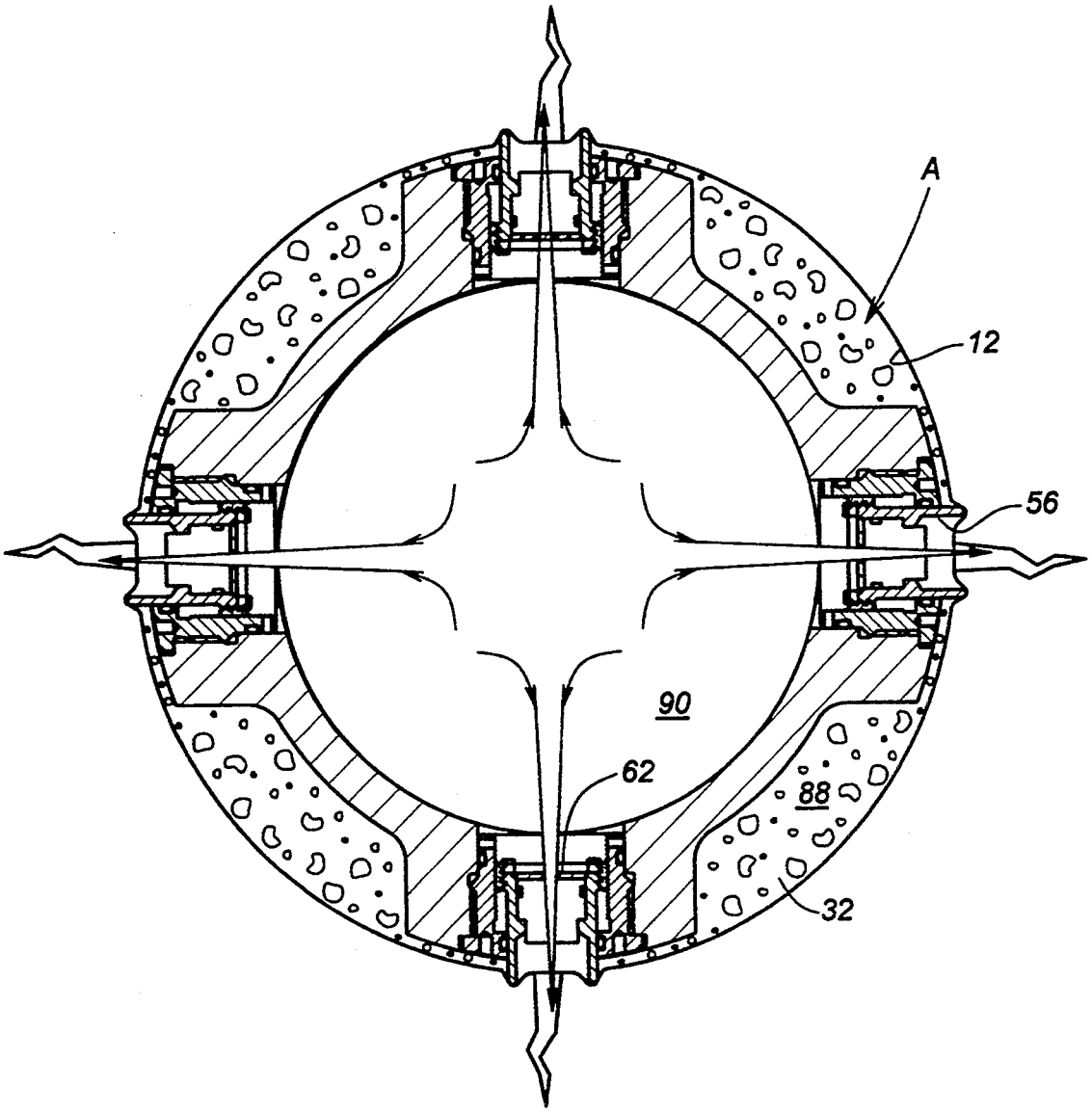
FIG. 11 illustrates the breaking of the rupture discs with flow beginning into the formation.
Figure 12:
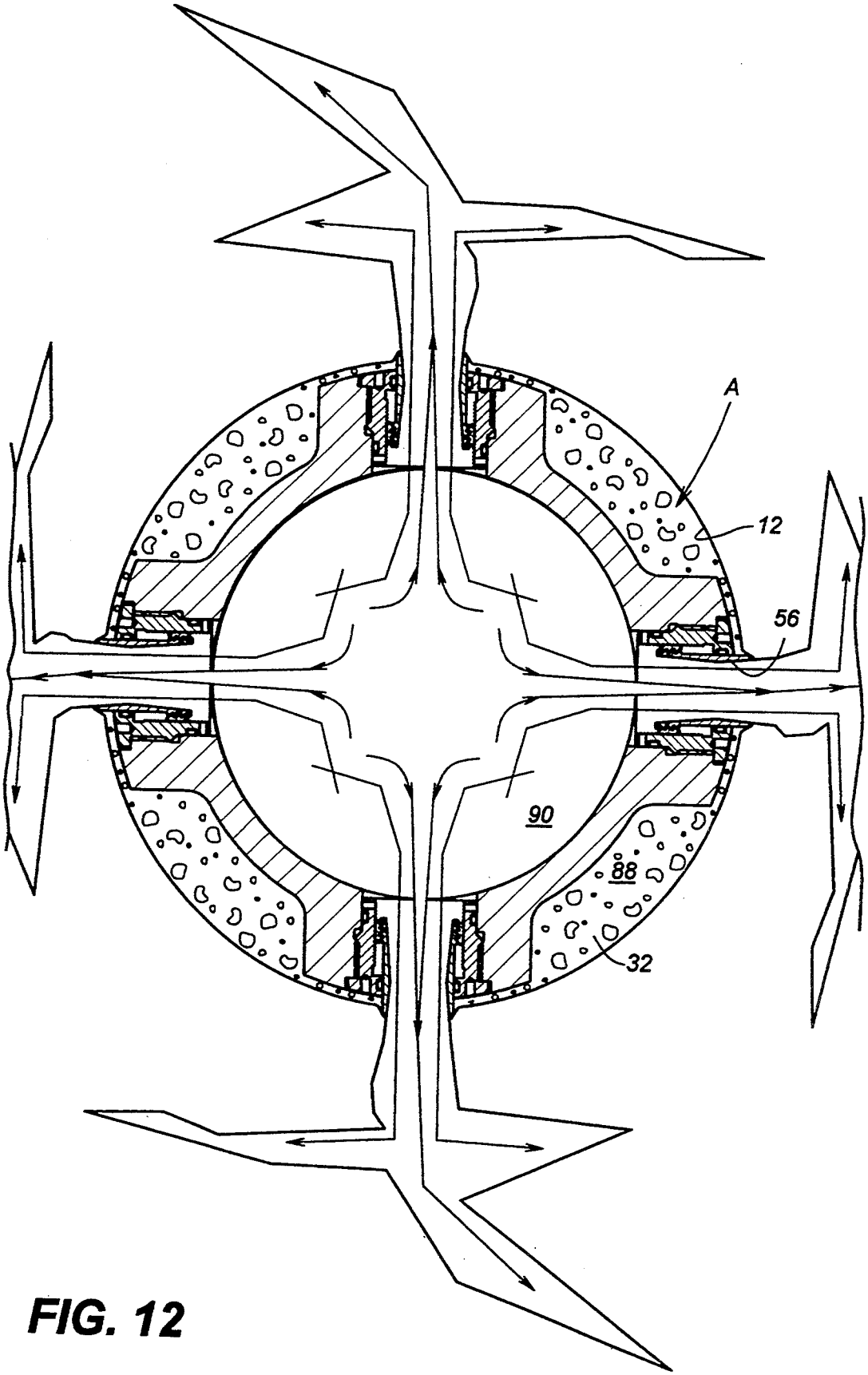
FIG. 12 illustrates the full erosion of the rupture discs indicating flow into the formation.
Figure 13:
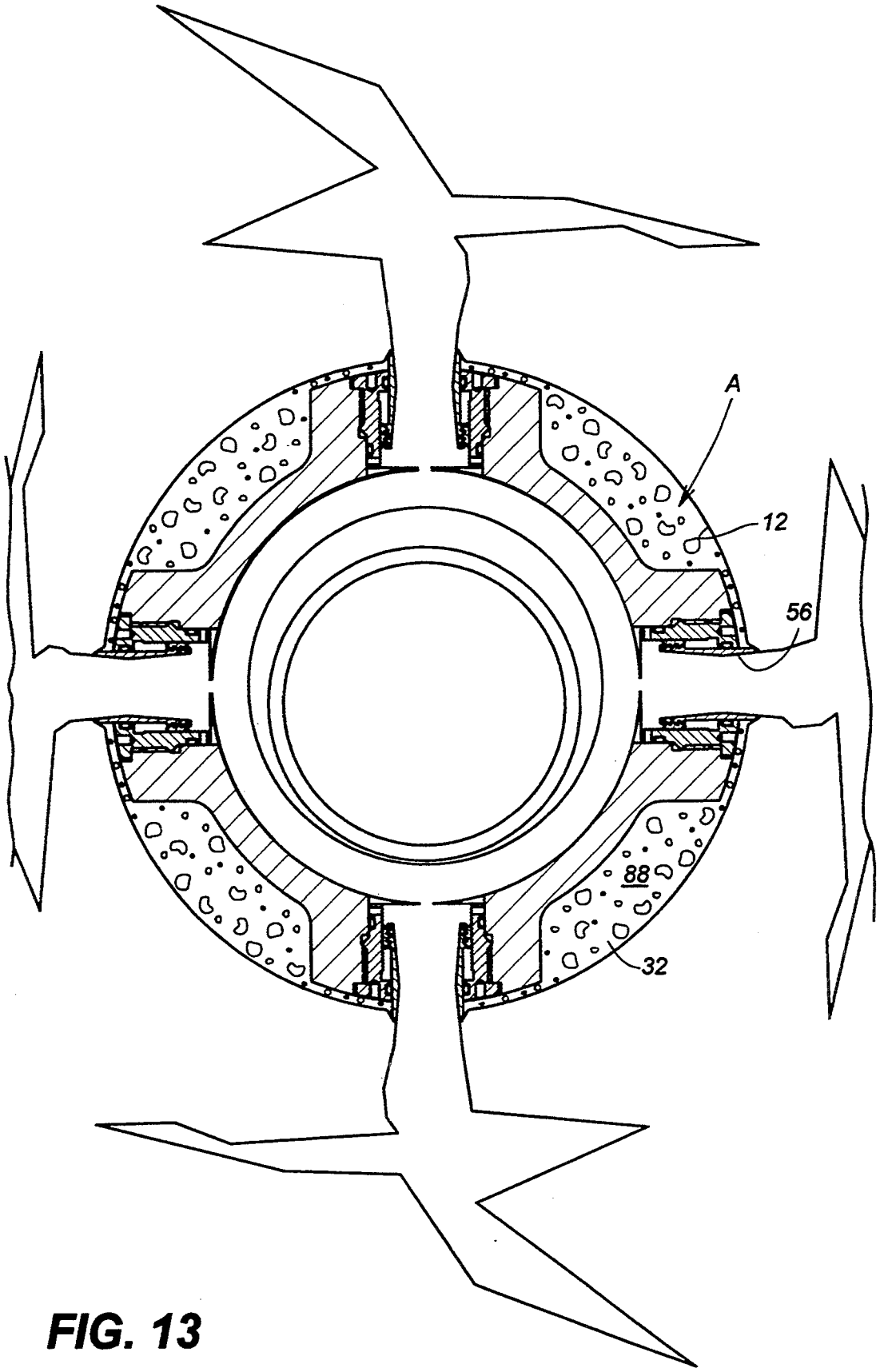
FIG. 13 illustrates the closed position of the sliding sleeve valve blocking off the ports through the rupture discs.

Referring now to FIGS. 8–13 and having fully described the operation of the piston 56 and the rupture disc 62, as well as the restriction plate 70, the method of the present invention is clearly illustrated. In FIG. 8, the pistons 56 are all retracted so that the apparatus A can be inserted into the wellbore 12. The outside dimensions of the apparatus are sufficiently small enough to allow for its insertion into the wellbore 12 with minimal additional clearance. A plurality of recesses 88 in the profile of the apparatus A allow for flowpaths for the cement, as illustrated in FIG. 10. FIG. 9 illustrates pressurization internally in bore 90 which, in effect, displaces the piston 56 outwardly without breaking rupture discs 62. The next step (FIG. 10) illustrates the insertion of the cementing strings, indicating the cementing procedure, which is also illustrated in FIG. 2. It should be noted that the cementing procedure can occur before outward displacement of pistons 56. Some operators desire to rotate the apparatus A while pumping cement. Clearly, in order to accomplish that, the pistons 56 must be in their retracted position to allow rotation. Having pumped the cement and before the cement has fully hardened, pressure is built up in bore 90 in the range of 750–1250 psi, which is generally sufficient to drive pistons 56 radially outwardly into the formation 12. This radial displacement of the pistons 56 creates fracture stresses in the formation even before the fluid energy, which will pass through pistons is released upon breakage of the rupture discs 62. Having concluded the cementing step, as illustrated in FIG. 10, and the displacement of the pistons 56, as illustrated in FIG. 9, the pressure is further raised to about 3000 psi to initiate rupture disc 62 failure. The restriction plates 70 maintain sufficient backpressure in bore 90 so that, ultimately, all rupture discs 62 fail. The restriction plates before they disintegrate, promote a backpressure within bore 90 which prevents sudden pressure drop within bore 90 from going below the failure pressure of the remaining rupture discs 62. By precluding short circuiting through the use of these dissolving plates 70, the backpressure in bore 90 is maintained for a predetermined time to allow all rupture discs 62 to break. Thereafter, using the preferred embodiment of the plates 70 illustrated in view A1 of FIG. 15, substantial disintegration of plates 70 takes place such that ultimately the opening size closely approximates or exceeds the size of bore 66. At that point, full flow is possible through bore 66 and bore 74. Because the piston 56 is extended into the formation and embedded therein, the fluid energy from the fluids pumped from the surface through bores 66 and 74 are more directly channeled into the formation, thus creating additional fracture stresses in the formation to assist in penetration into the formation for subsequent production. To the extent the pistons 56 had not been fully extended at the time of rupture of a given rupture disc 62, the fluid pressure exerted on the ruptured disc and on the piston body itself further drives the piston 56 into the formation 12, thus further enhancing the stresses applied to the formation 12. This combination of effects further promotes subsequent production, all without the use of explosive perforating guns.

Figure 16:
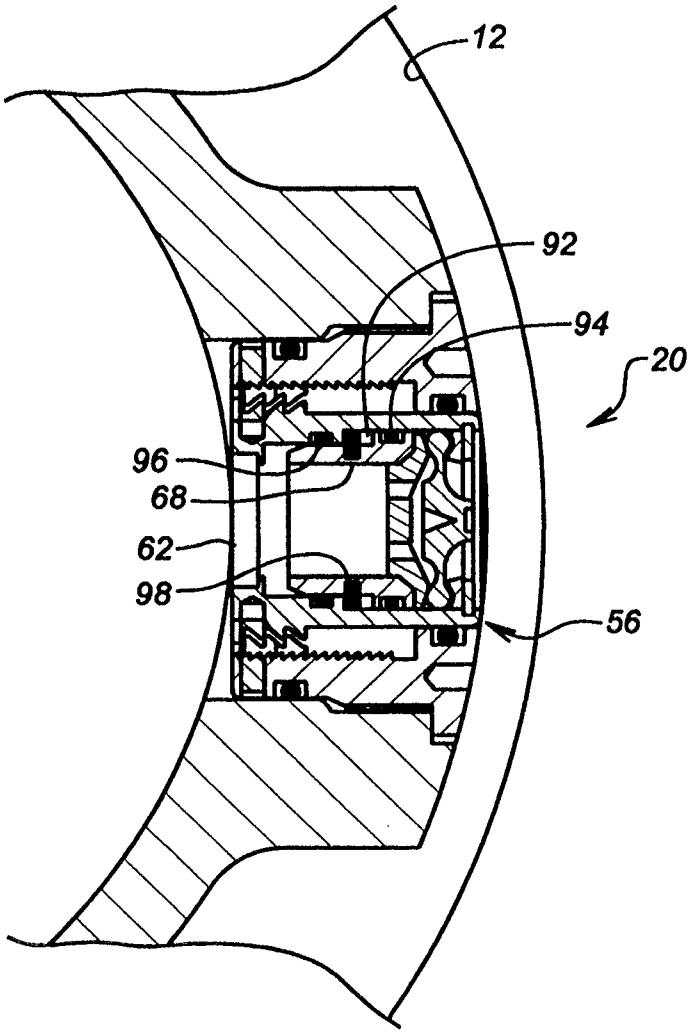
FIG. 16 is a sectional view of an alternative embodiment using an atmospheric chamber in the piston.
Figure 17:
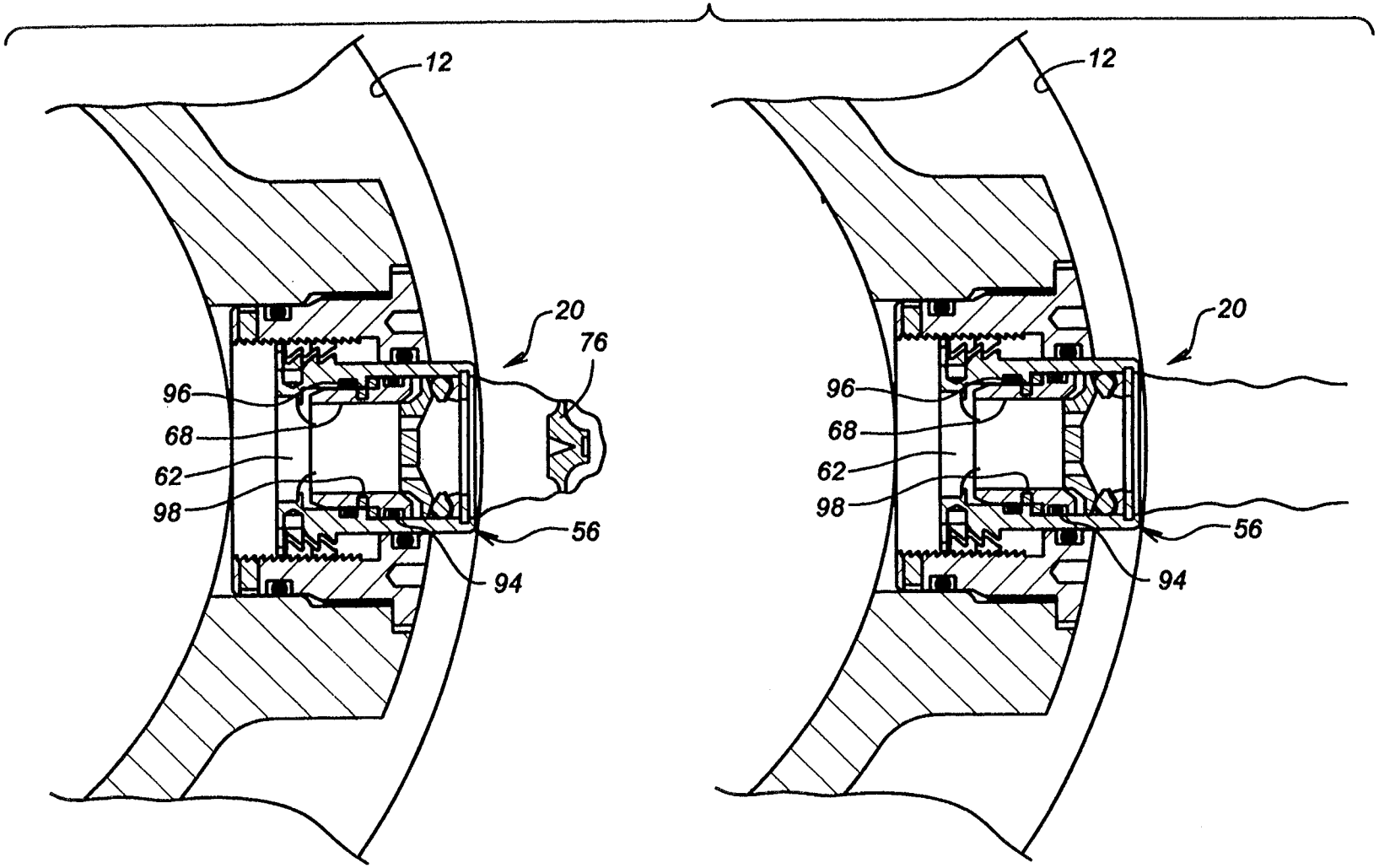
FIG. 17 is the view of FIG. 16 after shear pins have been broken and the atmospheric chamber used to promote rapid disc disintegration has been accessed.

FIGS. 16 and 17 illustrate alternative embodiments for the plug assembly 20. The construction of the components is similar to the prior embodiments, with the differences being the existence of a chamber 92 disposed between piston 56 and atmospheric chamber ring 68. Chamber 92 is sealed by seals 94 and 96. The relative positions of piston 56 and atmospheric chamber ring 68 are retained by shear pin or pins 98. In situations where the formation 12 has low permeability, it may offer sufficient resistance to movement of rupture disc 62 to prevent its breakage. It should be noted that behind the rupture disc 62, bores 66 and 74, as well as the openings 72 (see FIG. 14), are completely filled with an essentially incompressible material, grease. Accordingly, to promote movement behind the rupture disc 62 which will allow pressure differentials to initiate initial movement of the rupture disc 62 so that it can fail and be pushed out of the way, the shear pins 98 are sized to fail at an appropriate time so that piston 56 can move outwardly while atmospheric chamber ring 68 can be displaced further with respect to piston 56 so as to allow rupture disc 62 an opportunity to sufficiently flex to the failure point.

While the method and apparatus have been shown in use for fracturing a formation, other uses downhole are within the purview of the invention.

Figure 18:
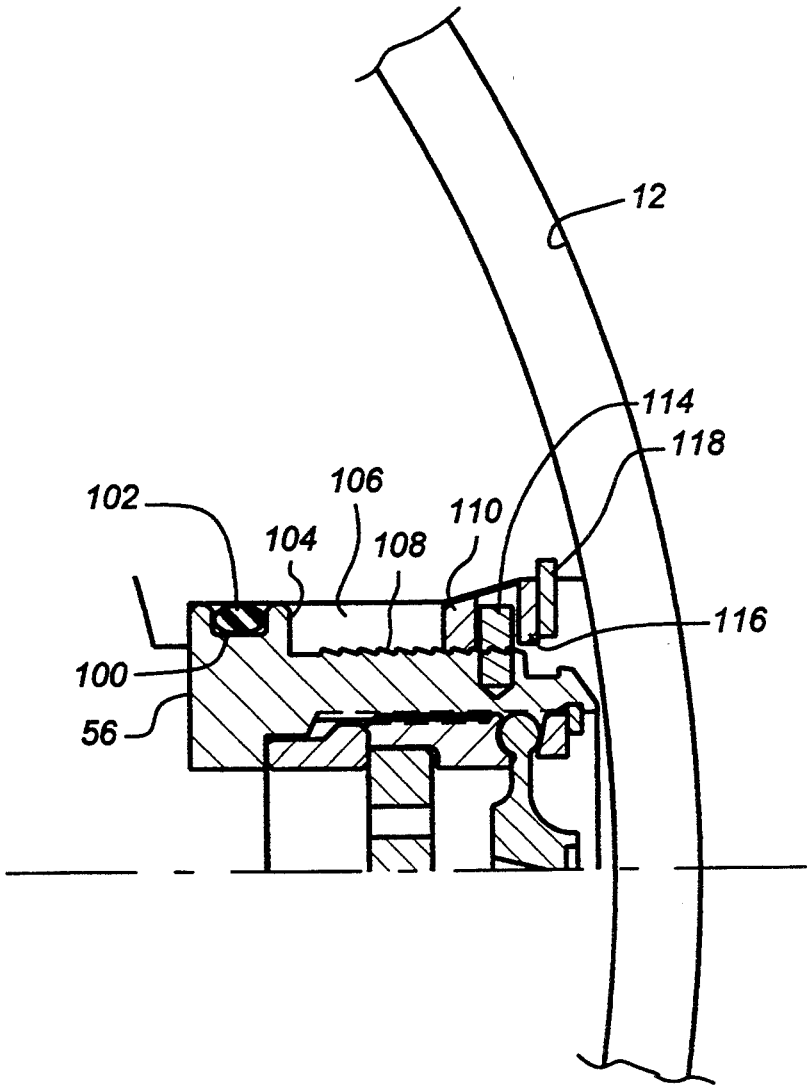
FIG. 18 is an alternative embodiment of the piston in an initial position.
Figure 19:
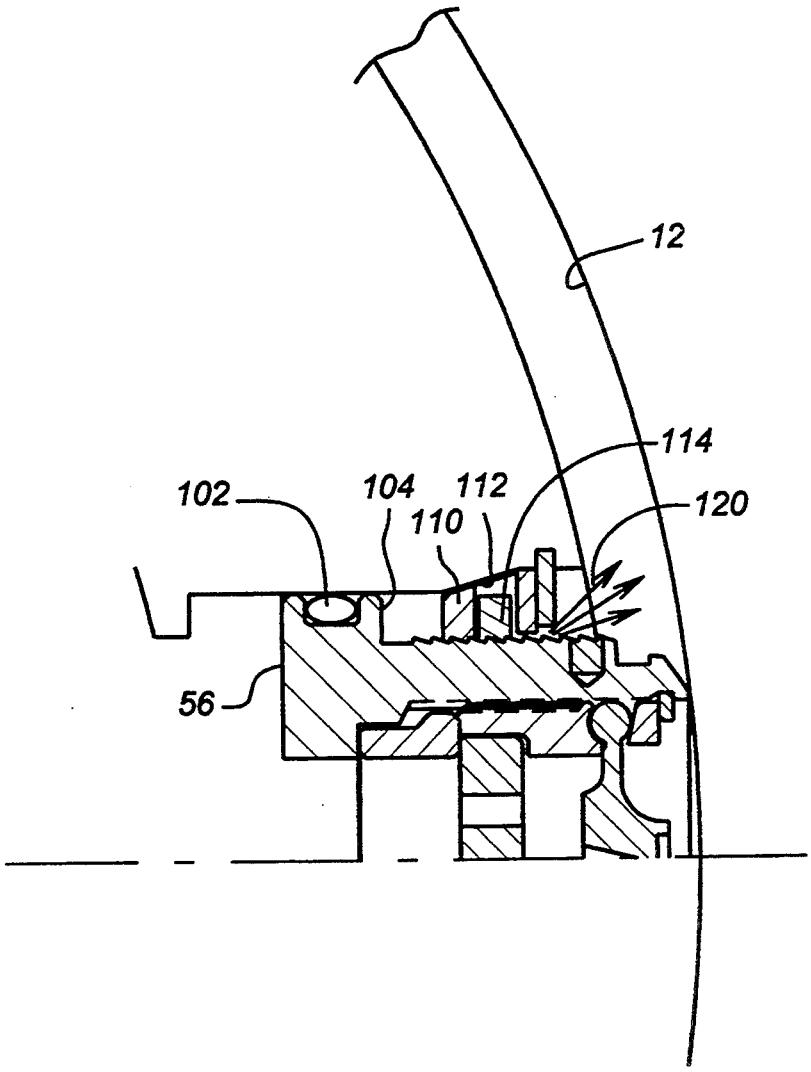
FIG. 19 is the view of FIG. 18 in the extended position.

Referring now to FIGS. 18 and 19, an alternative embodiment of the piston 56 is revealed. The components internal to piston 56 are identical to those shown in FIG. 14 or, alternatively, can be the internals shown in FIG. 16. However, the piston 56 is constructed differently in the embodiment shown in FIG. 18. In this embodiment, the piston 56 has a groove 100 which retains an O-ring 102. Piston 56 has a shoulder 104 which defines a cavity 106. The cavity is preferably packed with an incompressible material such as grease prior to inserting the apparatus A into the wellbore 12. Piston 56 further contains ratchet teeth 108. A lock ring 110 has teeth that are in alignment with teeth 108 so that when the piston 56 is pushed out by fluid pressure, it moves outwardly as shown in FIG. 19 with respect to lock ring 110. A taper 112 in the apparatus A keeps lock ring 110 from coming back to effectively set the piston 56 in its extended position as shown in FIG. 19. Before the piston 56 can move outwardly, shear pin or pins 114 must be severed due to initial outward movement of piston 56. Located on the other side of shear pins 114 is a ring 116 which acts as a centralizer for the piston 56 to prevent it from cocking as it is pushed outwardly to the position shown in FIG. 19. A snap ring 118 retains ring 116 in the position illustrated in FIGS. 18 and 19. Ring 116 is preferably unitary but can be made in segments without departing from the spirit of the invention. As a result, when the wellbore 12 is cemented and pressure is applied within the apparatus A so that it acts on pistons 56, the grease located in cavity 106 is pushed out past shear ring 116 where it contacts the cement that is located adjacent the wellbore 12 in the area of piston 56. The outward movement of the grease, illustrated by arrows 120 in FIG. 19, contaminates the cement in the local region around the piston and creates voids in the cement which allows the fluids that ultimately come through the interior of piston 56 to more easily invade the formation through the wellbore 12, thereby to induce fracture stresses in the formation through such penetration. As previously stated, the outward movement of pistons 56 into contact with the wellbore 12 creates a hoop stress in the surrounding formation. The distribution of the pistons 56 is preferably circumferential around the periphery of the apparatus. For each sliding sleeve member 16 which is open, an array of openings 44 is exposed to the interior of the apparatus A. In one embodiment, the distribution of the openings is in four staggered spirals, each of which covers 90° around the periphery of the apparatus A. However, other distributions which substantially cover the periphery of the apparatus A can be employed without departing from the spirit of the invention. After initiating some hoop stresses due to penetration of the formation 12 by pistons 56, the subsequent rapid introduction of fluid at high pressure through pistons 56 further induces fracture stresses for penetration into the formation. This, in turn, promotes future production from the formation into the wellbore 12.

Figure 20:
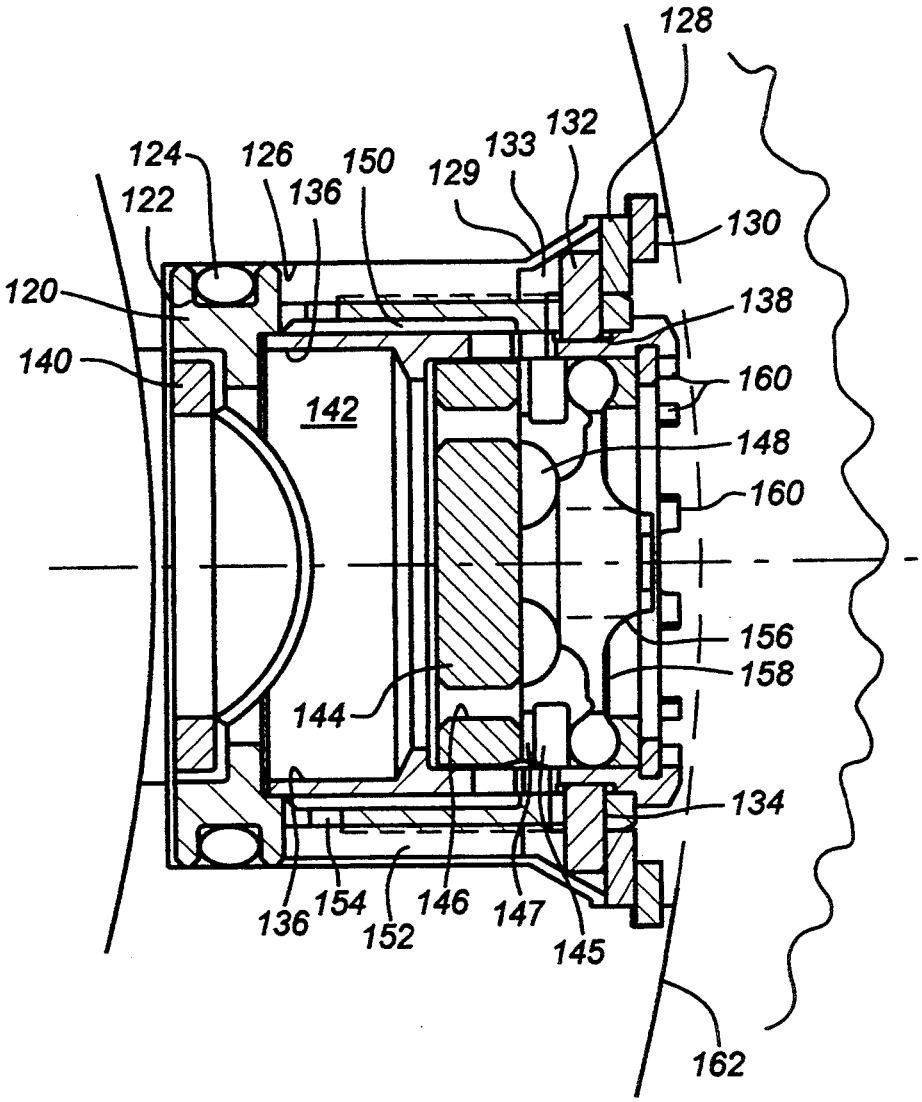
FIG. 20 is a sectional elevational drawing of a preferred embodiment of a piston assembly in the run-in position.
Figure 21:
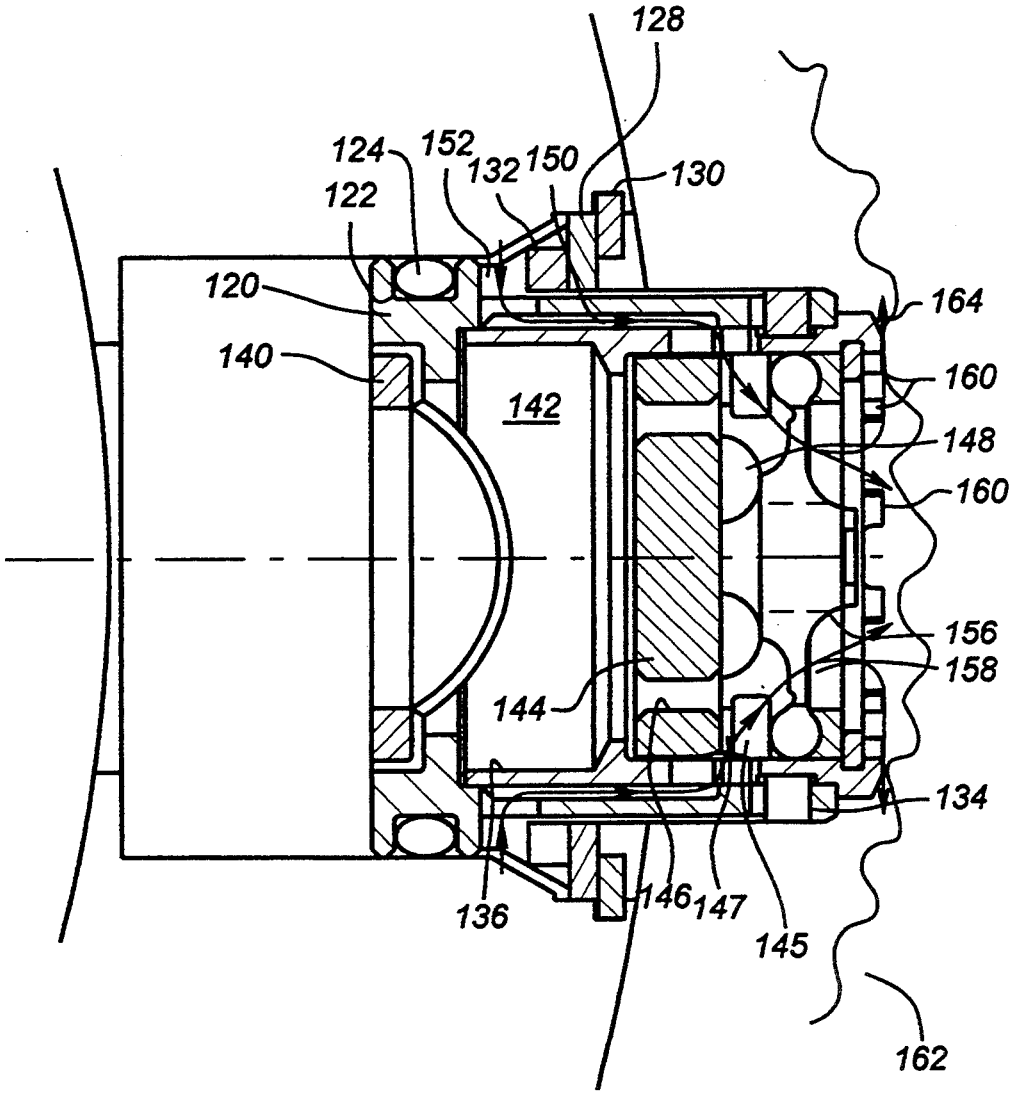
FIG. 21 is the view of FIG. 20 with the piston assembly extended.

The preferred embodiment of the piston is shown in FIGS. 20–23. Piston 120 has a groove 122 with an O-ring 124 which seals against wall 126. Shear ring 128 is further retained by snap ring 130. Shear ring 128 centralizes piston 120 and supports pins 132 enabling them to shear as shown in FIG. 21. Ring 128 also provides resistance against escape of grease outside of piston 120 from cavity 152. Instead, the path of least resistance for grease outflow is shown in FIG. 21 by arrows 164. Snap ring 130 aids in proper positioning and assembly of shear ring 128. Shear pin or pins 132 are further retained by a knurled feature to lock ring 129 and extend into piston 120 through opening 134. Shear pins 132 further extend into piston nose insert 136 via groove 138. A rupture disc 140 covers bore 142. Disposed in bore 142 is temporary restriction 144. It is held down by pins 145 and washer 147. Temporary restriction 144 preferably has a plurality of passages 146. Piston nose insert 136 has a plurality of openings 148 which communicate into cavity 150. Cavity 150 communicates with cavity 152 through openings 154. Bore 142 is covered by bladder 156. Bladder 156 has a plurality of razor slits 158 which allow for expansion and compression of the grease due to pressure and temperature effects. The bore 142 is therefore initially sealed off by rupture disc 140 at one end and bladder 156 at the other end. Cavities 150, 152 and bore 142 are initially all grease-filled up to and including the area around openings 148 and bladder 156.

The outer end of piston nose insert 136 has a plurality of castellations 160 (defined as protrusions which extend into the formation) to facilitate penetration into the formation.

The significant parts of piston assembly 120, shown in FIG. 20, now having been described, its operation will be reviewed. The piston assembly 120 isolates internal and external wellbore fluids during run in. The bladder 156 with its razor slits 158 does not act purely as a one-way check valve, but can allow some slight mixing of wellbore fluids with the grease. This can occur to an extent not significant enough to begin the dissolving process of temporary restriction 144. The rupture disc 140 is preferably made to resist 5,000 psi external cementation pressures. The rupture disc 140 is bi-directional in that it resists up to about 5,000 psi in the preferred embodiment from the outside and bursts with approximately 2,500 psi from the inside. These set points can be altered to suit the particular application without departing from the spirit of the invention. As clearly shown in FIG. 20, initially the entire piston assembly 120 is recessed within housing 162 to facilitate running in of the casing and to protect the piston assembly 120 from damage during run in. The casing 162, of course, can still be rotated during the cementing procedure as long as the piston assembly 120 has not been actuated to the position shown in FIG. 21. Bladder 156 can flex because of the razor slits 158 and can therefore through such flexing action compensate for differential pressures induced from downhole pressure variations, as well as temperature variations. Bladder 156 further acts as a barrier to cement from substantially contaminating the grease or from initiating the dissolving process as to temporary restriction 144 prior to the appropriate time. Bladder 156 acts further to prevent centrifugal mixing during rotation by retaining the grease within cavity 142.

In the preferred embodiment, shear pins 132 break at approximately 1,000 psi. As shown in FIG. 21, the piston assembly 120 moves upwardly while rupture disc 140 remains intact. However, cavity 152 has been reduced in volume due to the outward movement of piston assembly 120 with piston nose insert 136 moving in tandem. Due to the reduction in volume of grease cavity 152, grease flows through opening 154 into cavity 150 and through openings 148 against bladder 156 and ultimately outwardly through slits 158 and out between castellations 160 as indicated by arrows 164 in FIG. 21. Routing the grease through cavity 150 outside of the temporary restriction 144 allows for adjustment of the temporary restriction geometry to match different flow rates as required for various applications, without affecting the grease transfer feature. The castellations 160 dig into the formation to cause stress fractures. Since the piston assemblies 120 are disposed around the periphery of the casing 162, a hoop stress is created against the formation. The more piston assemblies 120 move outwardly due to the effect of the castellations 160, the more grease is pushed out through slits 158. In a preferred embodiment, the pistons can move out as much as about a half an inch per piston or almost an inch over the tool diameter. For example, an eight inch tool can be set in an 8 ½ inches and allow for almost half an inch of washout. As a result of the forcing of the grease between the castellations, grease is communicated to the formation and acts to displace any cement prior to the rupture of rupture disc 140. As a result, the formation in front of the face of the piston assembly 120 becomes coated with grease. The castellations 160 further crush rock to allow additional piston travel and its attendant grease pumping activity resulting from reduction in volume of cavity 152. It is this crushing effect which helps to initiate fractures to allow better communication ultimately into the formation when rupture disc 140 is broken. A lock ring 133 keeps the piston assembly 120 in an extended position during the setting of the cement. It also aids in trapping the grease in chamber 142 and directs the flow of grease toward bladder 156 when the piston assembly 120 is actuated. As previously stated for the other embodiments, the size and spacing of openings 146 can be altered to affect the operation of temporary restriction 144 regarding the length of time it takes to effectively dissolve, as well as the degree and length of time a back pressure is provided during the dissolution process.

Figure 22:
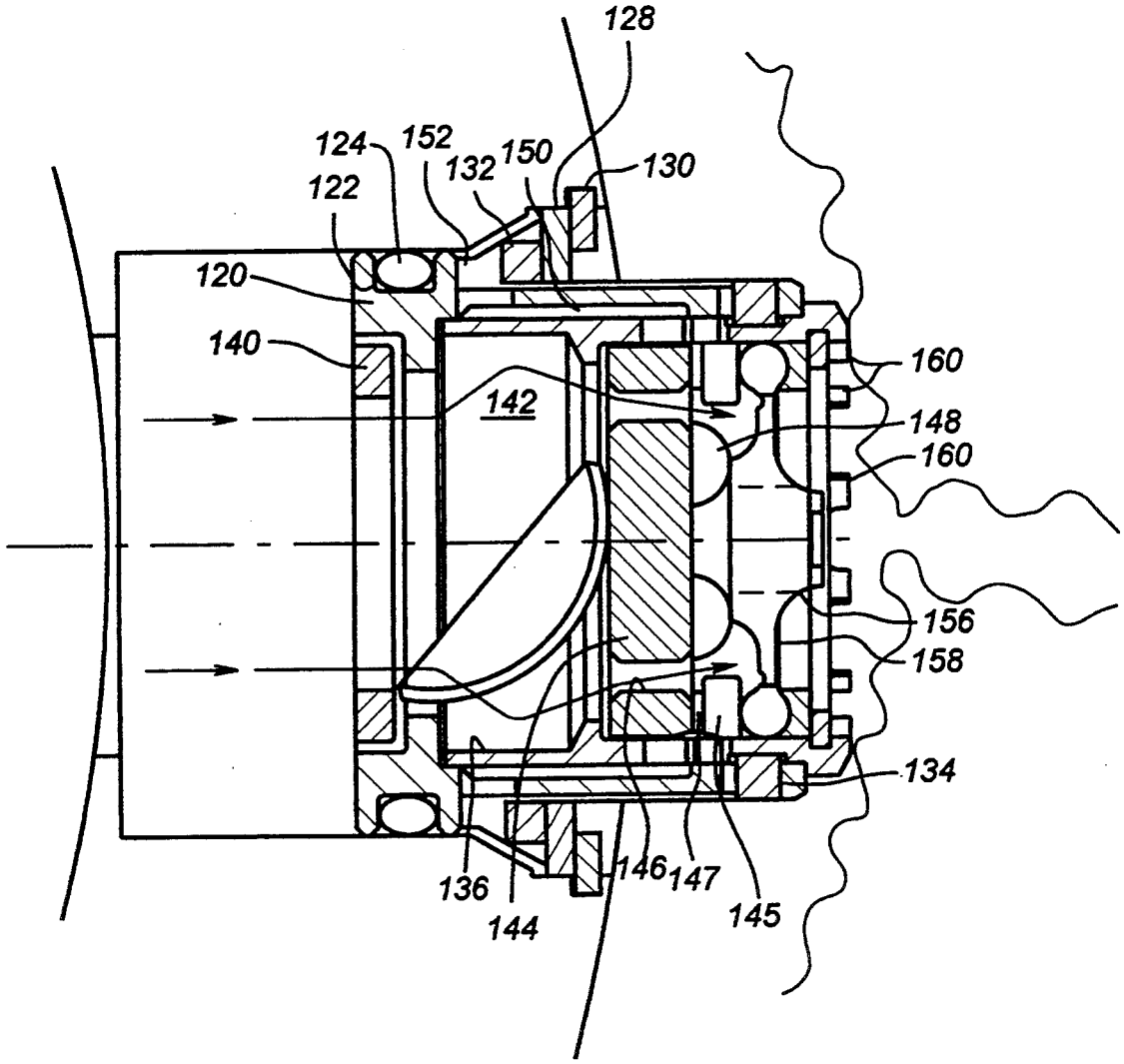
FIG. 22 is the view of FIG. 21 with the rupture disc initially broken.
Figure 23:
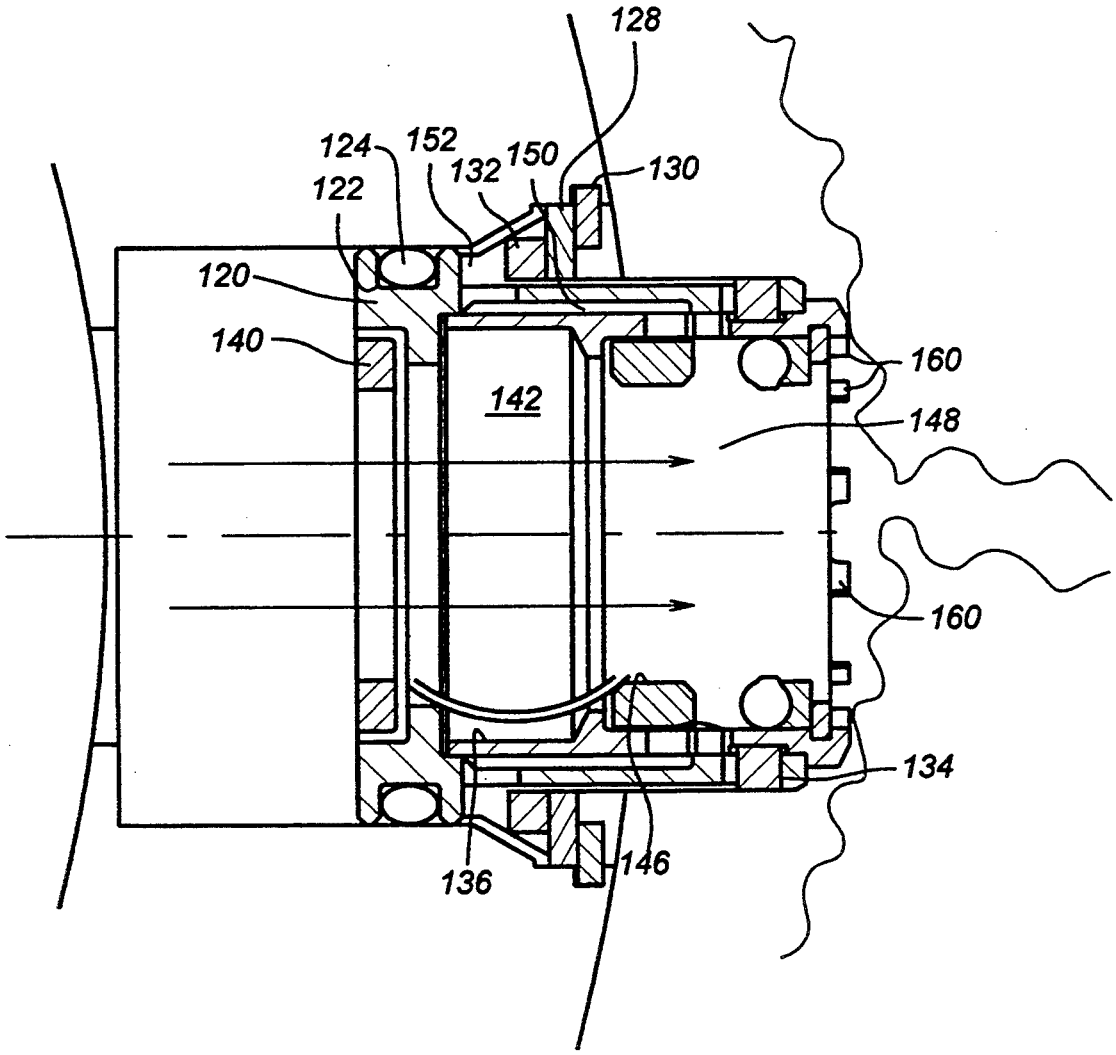
FIG. 23 is the view of FIG. 22 with the temporary restriction dissolved.

The internal pressure, as shown in FIG. 22, can be raised to a predetermined value, which in the preferred embodiment is approximately 2,500 psi. At this point, the rupture disc 140 bursts. Sufficient space is provided to let the disc swing out of the way of the flowpath. Upon rupture, the disc swings open and creates a flow area about 7 times greater than the initial flow area through temporary restriction 144. Initially after rupture, temporary restriction 144 provides the backpressure that urges any unbroken discs 140 to break. The temporary restriction 144 provides back pressure with flow to allow for all of the discs 140 to rupture. The flow area around the rupture disc 140 after rupture is approximately seven times the initial flow area of the temporary restriction 144. This feature tends to concentrate the pressure drop at the restriction and keeps the disc from deforming and bridging off across the temporary restriction holes. This feature is particularly useful when using bi-directional rupture discs for the temporary restriction 144 since bi-directional rupture discs are made of thicker material which doesn't disintegrate in the same fashion as a single direction rupture disc does upon rupture. The restriction afforded by temporary restriction 144 dissolves with minimum flow typically less than 300 gallons or about 7 barrels. In the preferred embodiment, it opens to its full open position at that time. At that point, all of the flow restriction occurs because of resistance from the formation, rather than resistance of the opening bore 142. This feature can be illustrated by comparing FIGS. 22–23. FIG. 23 shows the remnants of rupture disc 140 being pushed to the side, thereby allowing full flow through bore 142. The flow thus pushes the broken rupture disc 140 to the side. In the preferred embodiment, bore 142 can be somewhat larger than the one-half inch while the piston assembly 120 due to the compact construction can be contained in a space of about 1.25 cubic inches. Other bore sizes can be accommodated depending on the application. What is significant is that large bores can be used in the piston assembly 120 which is compact so that it can fully recessed into the casing and at the same time extend outwardly to initiate stress fractures in the formation. The automatic feed of grease further removes any cement from in front of the piston 120 to increase the effectiveness of the ultimate penetration into the formation once the rupture disc is broken and pushed out, as shown in FIG. 23. As stated with the other embodiments, the temporary restrictions 144 ensure that all of the rupture discs 140 will break preventing short circuits and ensuring uniform penetration into the formation through all of the bores 142 which open up when all of the rupture discs 140 break.

The foregoing disclosure and description of the invention are illustrative and explanatory thereof, and various changes in the size, shape and materials, as well as in the details of the illustrated construction, may be made without departing from the spirit of the invention.

We claim:

1. A casing apparatus for a wellbore, wall comprising:

an elongated housing formed having at least one opening thereon;

at least one first valve member operably connected to said housing to selectively obstruct and allow access to said opening;

piston means mounted to at least one of said openings and operable between a retracted and extended position upon application of a first predetermined pressure in said housing for forming a nondissolving conduit from said opening toward the wellbore wall;

pressure-regulating means in said conduit for creation of backpressure in said housing.

2. The apparatus of claim 1, wherein said pressure-regulating means further comprises:

a second valve member, said second valve member obstructing flow through said conduit until a second predetermined pressure is reached.

3. The apparatus of claim 2, wherein said pressure-regulating means further comprises:

a third valve member in said conduit with said second valve member;

said housing further comprises a plurality of openings, each of which further comprises one of said piston means, with said second and third valve members mounted in said conduit of each of said pistons;

each said third valve member becomes operative in its conduit upon opening of said second valve member in the same conduit.

4. The apparatus of claim 3, wherein:

said second valve member is made of a frangible material;

said third valve member is made of a dissolving material;

said third valve member restricts flow at least temporarily through said conduit in which it is mounted, whereupon initial opening of some of said second valve members, said third valve members mounted in said conduits where said second valve members have opened, retain, at least temporarily, sufficient backpressure within said housing to promote opening of the remainder of said second valve members.

5. The apparatus of claim 4, wherein:

said third valve member disintegrates upon flow therethrough to the point where it does not obstruct the conduit in which it is mounted.

6. The apparatus of claim 5, wherein said third valve member further comprises:

a plate formed having a plurality of holes adjacent its periphery whereupon initial flow therethrough, portions of said plate between said openings dissolve as said openings enlarge, making the central portion of said plate unsupported so it can be pushed out of said conduit by the flow therethrough.

7. The apparatus of claim 6, wherein said piston means further comprises:

a flexible cover over said conduit in each piston, said third valve member mounted in said conduit and sealed therein by said cover and said second valve member until said second predetermined pressure opens said second valve member in said conduit.

8. The apparatus of claim 7, wherein:

said cover further comprises a check valve;

said conduit is filled with a substantially incompressible material which does not initiate dissolution of said plate;

said cover and said piston means in said retracted position mounted to said housing so they do not protrude from said housing;

said cover responding to unbalanced forces thereon from the wellbore by flexing and allowing at least some of said incompressible material to exit said conduit through said check valve.

9. The apparatus of claim 8, wherein:

said first predetermined pressure is substantially lower than said second predetermined pressure;

said cover is forced out of said conduit upon opening of said second valve member.

10. The apparatus of claim 9, further comprising:

a selectively movable member mounted adjacent said piston and in said conduit, forming a variable volume cavity therebetween, said cavity sealed with a pressure lower than said first predetermined pressure when said movable member is in a first position, whereupon applied pressure on said movable member, resulting from opening of said second valve member, displaces said movable member to a second position, said movement to said second position facilitated by said lower pressure initially in said cavity; and said movement of said movable member to said second position creating a volume adjacent said second valve member to promote its fragmentation.

11. The apparatus of claim 10, wherein said movable member is selectively connected to said piston means by a shearing member.

12. A cementable casing apparatus for a wellbore into a formation, comprising:

a housing formed having a plurality of openings thereon selectively accessible from an interior thereof;

a first valve means on said housing to selectively allow access to said openings from the interior of said housing;

movable piston means mounted in said openings formed having a passage therethrough, said piston means movable from a retracted position substantially within said housing to an extended position in close proximity with the wellbore;

a second valve means in said passage for opening in response to pressure applied in said housing; and said second valve means permitting fluid flow through said passage and into the formation upon a predetermined pressure applied to it from said housing.

13. The apparatus of claim 12, further comprising:
fluid discharge means operably connected to said piston means, to release a fluid into the cement upon movement of said piston means toward said extended position, for weakening the cement adjacent said piston means to facilitate its movement toward said extended position.

14. The apparatus of claim 12, wherein said second valve means comprises:
a frangible valve member.

15. The apparatus of claim 14, wherein said second valve means further comprises:
a pressure-regulating member, said frangible valve member located upstream in said passage from said pressure-regulating member such that upon pressure buildup causing said frangible valve member to open, said pressure-regulating member at least temporarily restricts outward flow from the housing to the formation through said passage.

16. The apparatus of claim 15, wherein:
said pressure-regulating member is dissolvable.

17. The apparatus of claim 16, wherein:
said pressure-regulating member has a plurality of initial openings disposed about its periphery; and
whereupon flow therethrough resulting from breakage of said frangible valve member, backpressure at said frangible valve member is regulated until sufficient flow has enlarged said initial openings so that at least a central portion of said pressure-regulating member becomes insufficiently supported and is carried out of said passage with the flow.

18. The apparatus of claim 15, wherein:
said piston means is mounted substantially within said housing in said retracted position; and
said piston means further comprises:
removable cover means in said passage to at least temporarily isolate said pressure-regulating member by sealingly disposing said pressure-regulating member between said frangible valve member and said cover means in said passage.

19. The apparatus of claim 18, further comprising:
a check valve in said cover means;
a substantially incompressible isolating material disposed in said passage between said cover means and frangible valve member;
said cover means flexing in response to differential pressures across it when it is still blocking said passage; and
said check valve allowing flow of said isolating material therethrough and out of said passage to accommodate said flexing of said cover means.

20. The apparatus of claim 14, further comprising:
a selectively movable member in said passage mounted to said piston means and formed having a sealed variable volume cavity therebetween;
restraining means on said movable member to fix its position until a predetermined differential pressure on said member is reached; and
said cavity containing a compressible fluid at a lower pressure than applied pressure in said passage to facilitate defeating said restraining means and allowing said movable member to move thereby facilitating fragmentation of said frangible valve member.

21. A method of providing access into a formation through a cemented casing, comprising:
running a casing to the desired depth;
cementing the casing;
opening at least one casing valve on the casing to allow access to at least one opening having a piston therein;
pressurizing said casing to drive said piston toward the formation;
further pressurizing said casing to open at least one nondissolving valve located in a passage through said piston; and
penetrating the formation with flow through said opened valve.

22. The method of claim 21, further comprising the steps of:
providing a plurality of openings in said casing, each having said piston with passage and said valve therein;
providing a backpressure regulator in at least one of said passages to at least temporarily hold pressure in said casing after at least one of said valves in said pistons has opened; and
using said temporary retention of pressure in said casing to ensure opening of at least one other valve in said pistons.

23. The method of claim 22, further comprising the steps of:
making said valves in said pistons of a frangible material; and
making said backpressure regulator in said pistons of a dissolving material.

24. The method of claim 23, further comprising the steps of:
providing a removable flexible cover on said passage on said piston; and
isolating at least temporarily the backpressure regulator from well fluids by placing it in said passage between said valve and said cover.

25. The method of claim 24, further comprising the steps of:
providing an incompressible sealing fluid in said passage;
providing a valve in said cover; and
allowing some of said sealing fluid to escape said passage responsive to flexing of said cover.

26. The method of claim 25, further comprising the steps of:
blowing said cover out of said passage upon opening said valve in said piston; and
dissolving said backpressure regulator out of said passage through flow directed through it.

27. The method of claim 26, wherein said dissolving step further comprises:
flowing a dissolving fluid through a plurality of holes spread about the periphery of said regulator;
enlarging said holes by fluid flow therethrough;
removing support for a central portion by virtue of said enlargement; and
pushing said central portion out of said piston.

28. The method of claim 22, wherein:
positioning said pistons substantially in said housing during said running step;
rotating the casing during cementing;
orienting said openings so that said pistons, when driven toward the formation, are distributed about the entire periphery of said housing;
providing a plurality of clusters of openings, each cluster accessible through one of said casing valves; and
opening at least one casing valve for access to the formation.

29. The method of claim 21, further comprising the steps of:

storing a material which weakens cement in said casing adjacent said piston;

forcing said material from said casing upon driving said piston toward the wellbore along a path; and weakening said cement adjacent the path of said piston to facilitate said piston's penetration toward said wellbore, 30. The method of claim 23, further comprising the steps of:

providing a selectively movable member adjacent said frangible valve in said piston;

creating a sealed compartment between said movable member and said piston;

capturing a compressible fluid in said chamber initially near atmospheric pressure prior to being run into the wellbore;

moving said member in response to applied pressure thereon in a situation of low formation permeability;

using the space created, adjacent said frangible valve, by movement of said movable member, to promote its fragmentation;

allowing said movable member a way to move when said formation permeability is low by virtue of compressing said compressible fluid when said chamber volume is reduced due to movement of said member.

31. A piston assembly for use in providing access to a formation from a casing, comprising:

a piston housing;

a movable piston in said piston housing;

a variable-volume cavity defined at least in part by said piston, said cavity decreasing in volume upon outward movement of said piston with respect to the casing;

said piston defining a flowpath therethrough;

means for selectively retaining a substantially incompressible fluid in said cavity, whereupon a decrease in volume of said cavity said fluid is forced out of said cavity and through said flow in said piston and toward the formation.

32. The piston assembly of claim 31, wherein said retaining means further comprises:

a flexible member spanning said flowpath;

a valve member spanning said flowpath, said valve member actuable to an open position upon application of a predetermined pressure thereto;

whereupon opening of said valve member after outward movement of said piston housing, said flexible member is displaced by said substantially incompressible fluid out of said flowpath.

33. The piston assembly of claim 32, further comprising:

a temporary restriction in said flowpath between said flexible member and said valve member, said restriction substantially covered by said substantially incompressible fluid until said valve member is actuated to an open position.

34. The piston assembly of claim 32, wherein:

said flexible member has at least one opening, said substantially incompressible fluid flowing from said cavity through said flowpath and out through said opening in said flexible member.

35. The piston assembly of claim 34, wherein:

said piston housing further comprises castellations on one end thereof to facilitate its penetration into the formation;

said substantially incompressible fluid, after flowing through said opening in said flexible member, flowing radially outwardly around said castellations.

36. The piston assembly of claim 31, further comprising:

a ratchet assembly on said piston housing to retain said housing in its outward position with respect to the casing.

37. A casing assembly for a wellbore wall, comprising:

a casing housing having a plurality of openings;

a piston assembly in each said opening, further comprising:

a piston housing movably mounted to said casing housing for movement along a path, having a piston opening therein;

means defined at least in part by said piston housing for storing and forcing out a fluid through said piston opening and toward the wellbore wall in said path of said piston housing as a result of said piston housing being driven toward the wellbore wall, said fluid weakening the wellbore wall to promote penetration of said piston housing.

38. The casing assembly of claim 37, further comprising:

a pressure-responsive valve member in said piston housing, said valve member allowing flow communication from within said casing to the wellbore through said piston opening when opened;

backpressure-regulating means in said piston housing for selectively regulating backpressure in said casing housing after at least one of said pressure-responsive valve members has opened to allow any remaining unopened valve members to open from said backpressure.

39. The casing assembly of claim 38, wherein said backpressure-regulating means further comprises:

a dissolving member having at least one initial opening therethrough;

whereupon opening of a valve in said piston housing, resistance to flow therethrough is initially principally through said dissolving member rather than said valve member.

40. The casing assembly of claim 39, wherein:

said piston housing provides a flowpath for the fluid when said piston is driven, independent of said opening in said dissolving member.

41. A casing assembly for a wellbore wall, comprising:

a casing housing a plurality of openings;

a piston assembly in each said opening, further comprising:

a piston housing movably mounted to said casing housing, having a piston opening therein;

means defined at least in part by said piston housing for storing and forcing out a fluid through said piston opening a result of said piston housing being driven toward the wellbore wall;

a pressure-responsive valve member in said piston housing, said valve member allowing flow communication from within said casing to the wellbore through said piston opening when opened;

backpressure-regulating means in said vision housing for selectively regulating backpressure in said casing housing after at least one of said pressure-responsive valve members has opened to allow any remaining unopened valve members to open from said backpressure;

said backpressure-regulating means further comprising:

a dissolving member having at least one initial opening therethrough;

whereupon opening of a valve in said piston housing, resistance to flow therethrough is initially principally through said dissolving member rather than said valve member;

said valve member swings substantially out of a flowpath through said opening in said piston housing; and said dissolving member, after sufficient flow therethrough, does not obstruct said flowpath through said opening in said piston housing.

42. The casing assembly of claim 41, wherein:

said piston housing is responsive to casing housing pressure to move outwardly toward said wellbore while ejecting fluid through said means for storing and forcing;

said valve member responsive to higher pressure in said casing housing than said pressure to urge said piston housing outwardly.

said valve member swings substantially out of a flowpath through said opening in said piston housing; and said dissolving member, after sufficient flow therethrough, does not obstruct said flowpath through said opening said piston housing.

* * * * *